US012796882B2

(12) United States Patent
Zahner

(10) Patent No.: US 12,796,882 B2
(45) Date of Patent: Nov. 17, 2026

(54) FLOOR CLEANING MACHINE

(71) Applicant: Greg Zahner, Lawson, MO (US)

(72) Inventor: Greg Zahner, Lawson, MO (US)

( * ) Notice: Subject to any disclaimer, the term of this patent is extended or adjusted under 35 U.S.C. 154(b) by 468 days.

(21) Appl. No.: 18/486,185

(22) Filed: Oct. 13, 2023

(65) Prior Publication Data

US 2025/0120558 A1 Apr. 17, 2025

(51) Int. Cl.

*A47L 11/40* (2006.01)
*A47L 11/28* (2006.01)
*A47L 11/284* (2006.01)

(52) U.S. Cl.

CPC ..... *A47L 11/4036* (2013.01); *A47L 11/28* (2013.01); *A47L 11/284* (2013.01); *A47L 11/4044* (2013.01); *A47L 11/4069* (2013.01); *A47L 11/4077* (2013.01); *A47L 11/4083* (2013.01)

(58) Field of Classification Search

CPC .. A47L 11/4069; A47L 11/4036; A47L 11/28; A47L 11/4044; A47L 11/4077; A47L 11/4083; A47L 11/12; A47L 11/125; A47L 11/284; A47L 11/29; A47L 11/294; A47L 11/30; A47L 11/307

See application file for complete search history.

(56) References Cited

U.S. PATENT DOCUMENTS 263,399 A 8/1882 Gardner
493,726 A 3/1893 Ivey
598,253 A 2/1898 McKee
1,566,371 A 12/1925 Brownrig
1,578,700 A 3/1926 Anderson
1,892,067 A 12/1932 McMillan
2,023,588 A 12/1935 Heckroth
2,193,419 A 3/1940 George
2,336,884 A 12/1943 Ottoson
2,722,790 A 11/1955 Smith
3,118,315 A 1/1964 Loosli
3,188,873 A 6/1965 Vowell et al.
3,400,956 A 9/1968 Buchwald
3,626,719 A 12/1971 Church
3,715,772 A 2/1973 Downing et al.
4,024,597 A 5/1977 Fouracre
4,025,210 A 5/1977 Johnson
4,125,683 A 11/1978 Beckford
4,131,966 A 1/1979 Gross
4,138,764 A 2/1979 Eschenbach et al.
4,158,246 A 6/1979 Meadows et al.
4,276,673 A 7/1981 Brook (Continued)

FOREIGN PATENT DOCUMENTS

WO WO 99/37198 A1 * 7/1999 ..... A47L 11/34

*Primary Examiner* — Laura C Guidotti
(74) *Attorney, Agent, or Firm* — Thorpe North & Western, LLP

(57) ABSTRACT

A floor cleaning machine has a base, a wheel, a handle, a motor, and a power source. A low-profile extension arm extends from the base. Ahead is carried by a distal end of the extension arm. A shuttle is carried by and reciprocally positioned in the head. A scrub pad is coupled to the shuttle. The head is pivotally coupled to the distal end of the extension arm and has at least two different rotational orientations with respect to the extension arm to selectively orient the linear axis with respect to the extension arm. A lock selectively locks the head in one of the at least two different rotational orientations.

19 Claims, 15 Drawing Sheets

(56) References Cited

U.S. PATENT DOCUMENTS

| | | | | |
|---|---|---|---|---|
| 4,299,004 | A | 11/1981 | Lancaster | |
| 4,506,559 | A | 3/1985 | Francke et al. | |
| 4,685,342 | A | 8/1987 | Brackett | |
| 4,783,872 | A * | 11/1988 | Burhoe | A47L 11/4038 15/49.1 |
| 4,829,719 | A | 5/1989 | Braselton | |
| 4,860,450 | A | 8/1989 | Achille | |
| 5,111,711 | A | 5/1992 | Engel et al. | |
| 5,186,193 | A | 2/1993 | Gullberg et al. | |
| 5,298,080 | A | 3/1994 | Von Vett | |
| 5,301,471 | A | 4/1994 | Fisher | |
| 5,341,536 | A | 8/1994 | Hill | |
| 5,351,567 | A | 10/1994 | Brackett | |
| 5,470,272 | A | 11/1995 | Kikuchi et al. | |
| 5,545,080 | A | 8/1996 | Clowers et al. | |
| 5,690,545 | A | 11/1997 | Clowers et al. | |
| 5,797,157 | A | 8/1998 | Gregg | |
| 5,848,334 | A | 12/1998 | Kamola | |
| 5,950,268 | A | 9/1999 | Murphy et al. | |
| 5,956,792 | A | 9/1999 | Gutelius et al. | |
| 5,978,999 | A | 11/1999 | deBlois et al. | |
| 6,058,542 | A | 5/2000 | Lo | |
| 6,120,363 | A | 9/2000 | Dunn | |
| 7,140,060 | B1 * | 11/2006 | Walker | A47L 11/4069 15/98 |
| 7,717,689 | B2 | 5/2010 | Sato et al. | |
| 8,113,328 | B2 | 2/2012 | Harrison et al. | |
| 2002/0039946 | A1 | 4/2002 | Serkh | |
| 2003/0108384 | A1 | 6/2003 | Huang et al. | |
| 2004/0019989 | A1 | 2/2004 | Zahner | |
| 2005/0196084 | A1 | 9/2005 | Kitahara et al. | |
| 2008/0190699 | A1 | 8/2008 | Ohta | |
| 2009/0062046 | A1 | 3/2009 | Lindemann | |
| 2011/0165980 | A1 | 7/2011 | Hoeting et al. | |
| 2012/0246848 | A1 | 10/2012 | Hruby | |
| 2018/0172126 | A1 | 6/2018 | Zahner | |
| 2022/0288740 | A1 * | 9/2022 | Biffignandi | B24B 29/005 |

* cited by examiner

FLOOR CLEANING MACHINE

BACKGROUND

Floor cleaning can provide difficulties in certain situation and locations, such as underneath equipment, along edges, and in grout lines.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
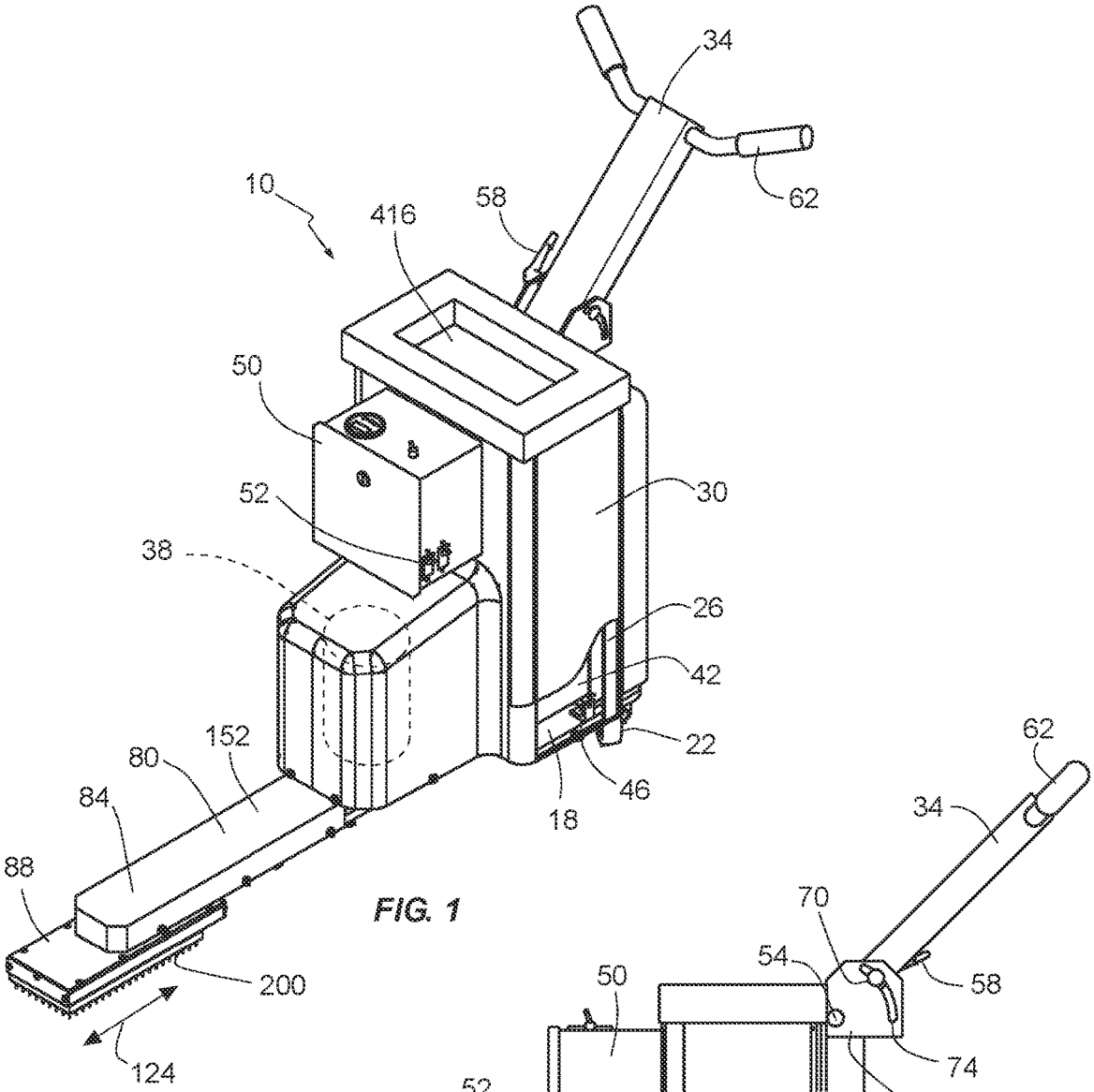
FIG. 1 is a perspective view, partially broken away, of an example floor cleaning machine in accordance with one embodiment.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention provides a floor cleaning machine capable of cleaning difficult areas and in difficult circumstances. For example, the floor cleaning machine can reach under equipment, such as gondolas, counters, and deli, bakery and meat tables. The floor cleaning machine can clean along edges and baseboards. In addition to cleaning, the machine can also be used to strip, burnish and sand. The machine can clean different surfaces, such as concreate and wood. The machine can eliminate scaping by hand, or so called "doodlebugging", with a scouring pad on a pole. The machine can reciprocate up to 3000 times per minute or more. The machine can operate ergonomically, efficiently and quietly to clean floors.

Figure 2:
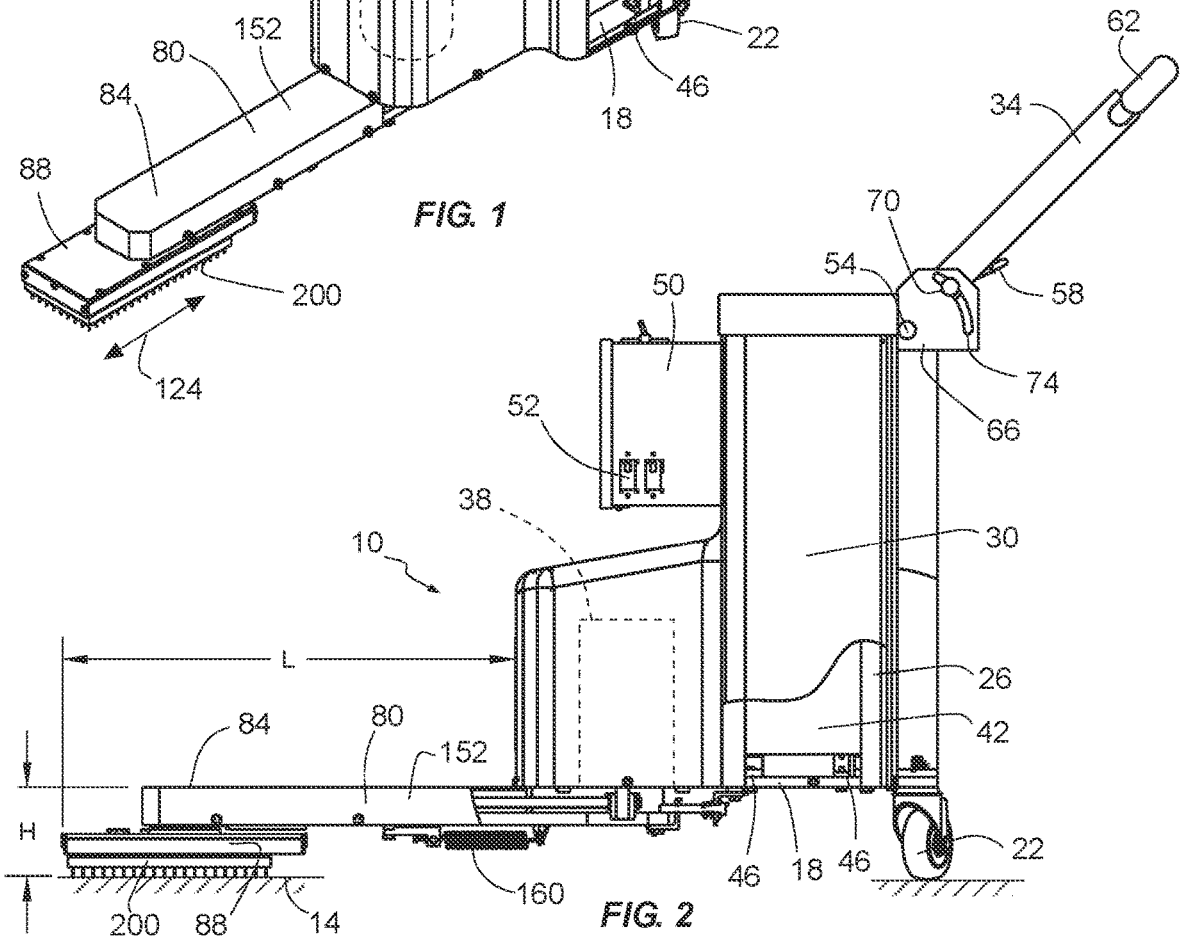
FIG. 2 is a side view, partially broken away, of the floor cleaning machine of FIG. 1.
Figure 3:
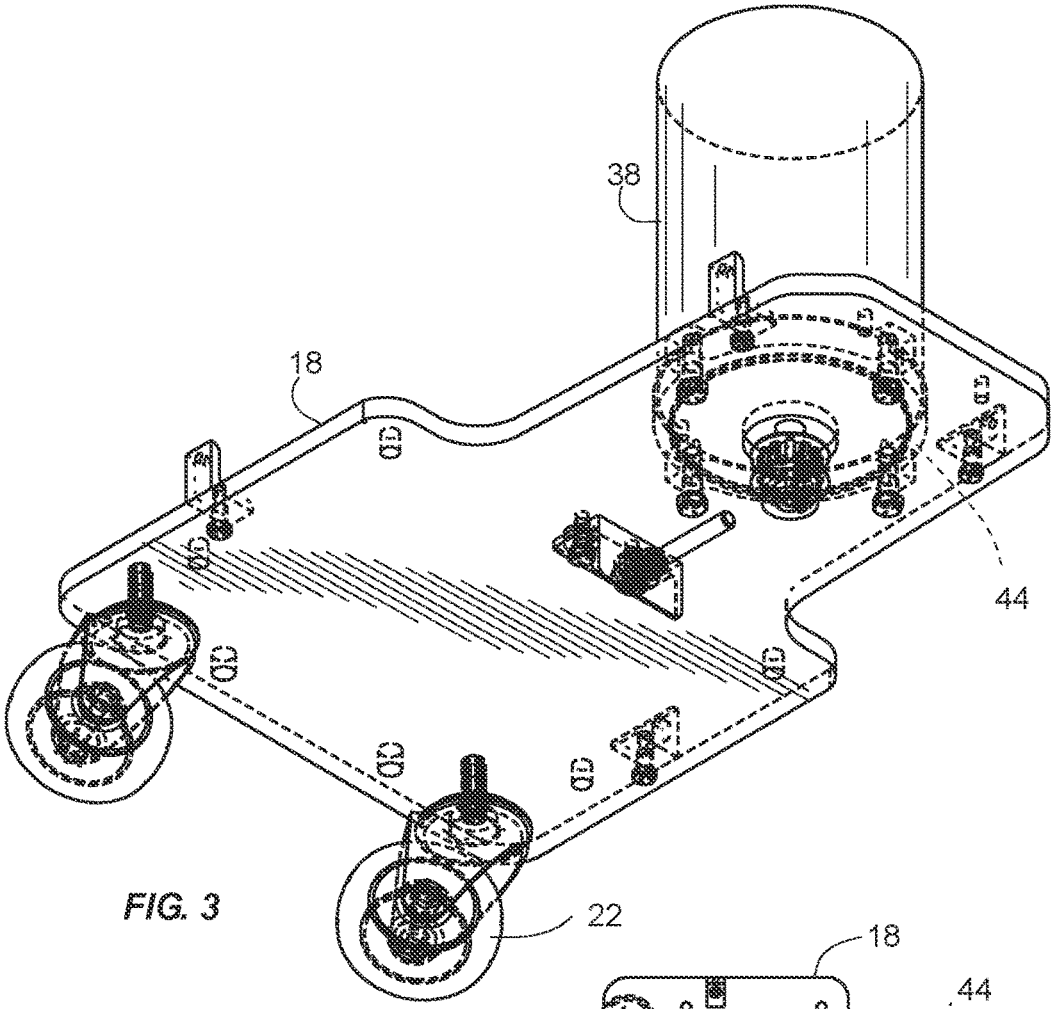
FIG. 3 is a partial bottom perspective view of an example base of the cleaning machine in FIG. 1*a* in accordance with one embodiment.
Figure 4:
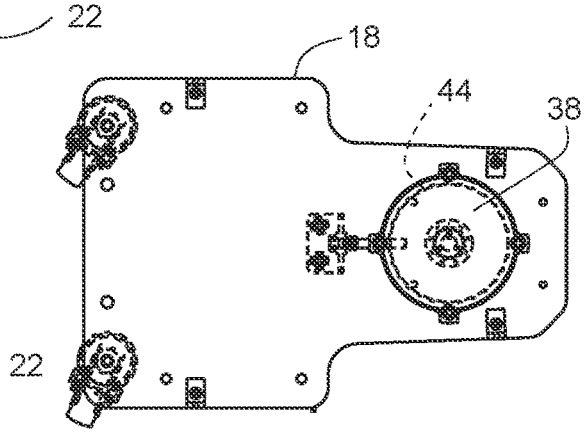
FIG. 4 is a top view of the base of FIG. 3.
Figure 6:
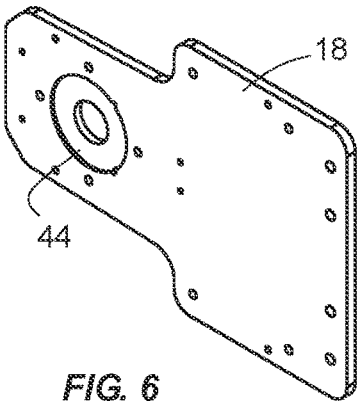
FIG. 6 is a perspective view of the base of FIG. 3.
Figure 5:
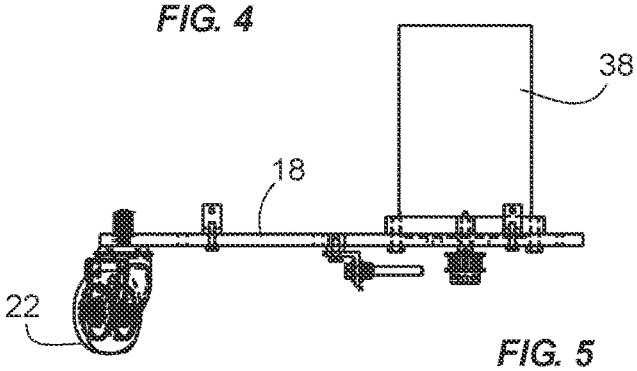
FIG. 5 is a side view of the base of FIG. 3.

Referring to FIGS. 1 and 2, a floor cleaning machine 10 is shown by way of example to clean floors 14. The machine 10 can have a base 18 movable on a support surface, such as the floor 14, with one or more wheels 22 supporting the base 18 on the support surface or the floor 14. The base 18 can have a support frame 26 and a housing 30. In addition, the machine 10 can have a handle 34 coupled to the base 18 and/or the support frame 26 to manipulate and move the base 18 on the wheels 22. The machine 10 can have a motor 38 and a power source 42 coupled to the motor 38. The power source 42 can be carried by the base 18 and located in the housing 30. In one aspect, the power source 42 can be a rechargeable battery, such as an absorbent glass mat (AMG) or gel battery. In one aspect, the motor 38 can be a rotational electric motor and can be carried by the base 18 and located in the housing 30.

In one aspect, the base 18 can have a solid metal plate to support the motor 18 and the battery 42. In another aspect, the base 18, or the plate thereof, can have a countersunk flange 44 to receive an end of the motor 18 to help place the motor 18, as shown in FIGS. 3-6. In another aspect, the housing 30 can be formed of rotationally molded plastic to reduce noise. In addition, sound dampeners, such as compressible foam or rubber pads 46, can be placed throughout the machine 10, such as between metal parts, or metal parts and the plastic housing 30, to reduce noise. The machine 10 has been found to have a decibel rating or measurement below 75 decibels. In another aspect, a pair of wheels 22 can be located at a rear of the base 18.

In another aspect, the machine can have an electrical box 50 coupled to the housing 30 and/or the frame 26. The electrical box 50 can contain electrical components, such as a breaker 52, for ease of service, such as resetting the breaker, without taking apart the machine 10. For example, the electrical box 50 can have a panel or door to allow access. In addition, the electrical box 50 can carry gauges and controls for the machine 10 and the motor 38. For example, a gauge can indicate hours run of the motor 38, while another gauge can indicate the charge level of the battery 42. A control can include a power switch for the motor 38 that can be coupled between the motor 38 and the battery 42. The electrical box 50 can also carry indicators, such as an indicator light to show that the power is on and/or another indicator light to show the battery 42 is charging.

In another aspect, the handle 34 can be ergonomic and adjustable to reduce fatigue and ease handling of the machine. The handle 34 can be pivotally coupled to the frame 26 at a pivot 54 and locked in multiple angular orientations by a lock 58 to position a grip 62 of the handle 34 at a desired elevation. The grip 62 can be cushioned to reduce transmission of vibration to an operator. The lock 58 and the pivot 54 of the handle 34 can include a bracket 66 fixed to the frame 26 and a fastener 70 fixed to the handle 34. An arcuate slot 74 can be formed in the bracket 66 to slideably receive the fastener 70. The fastener 70 can be tightened to selectively fix the fastener 70 in the arcuate slot 74 at a desired orientation of the handle 34 and a desired elevation of the grip 62.

A low-profile extension arm 80 can extend from the base 18. In one aspect, a proximal end of the extension arm 80 can be coupled beneath the base 18. The extension arm 80 can extend horizontally out from the base 18. The extension arm 80 can be low-profile and positioned adjacent to the support surface and the floor 14 to fit under equipment, such as gondolas, counters, displays, shelves and tables. For example, the extension arm 80 can have a vertical height H or elevation less than or equal to 5¼ inches, in one aspect; less than or equal to 4¾ inches, in another aspect; and less than or equal to 3¾ inches in another aspect. The vertical height H can be measured from a top of the extension arm 80 to a bottom of a scrub pad 200. Thus, the extension arm 80 can be long and low to reach under equipment. In one aspect, the extension arm 80 can be formed by a metal plate with a proximal end coupled to and below the metal plate of the base 18. A pair of blocks can be fastened between the base 18 and the extension arm.

Figure 8:
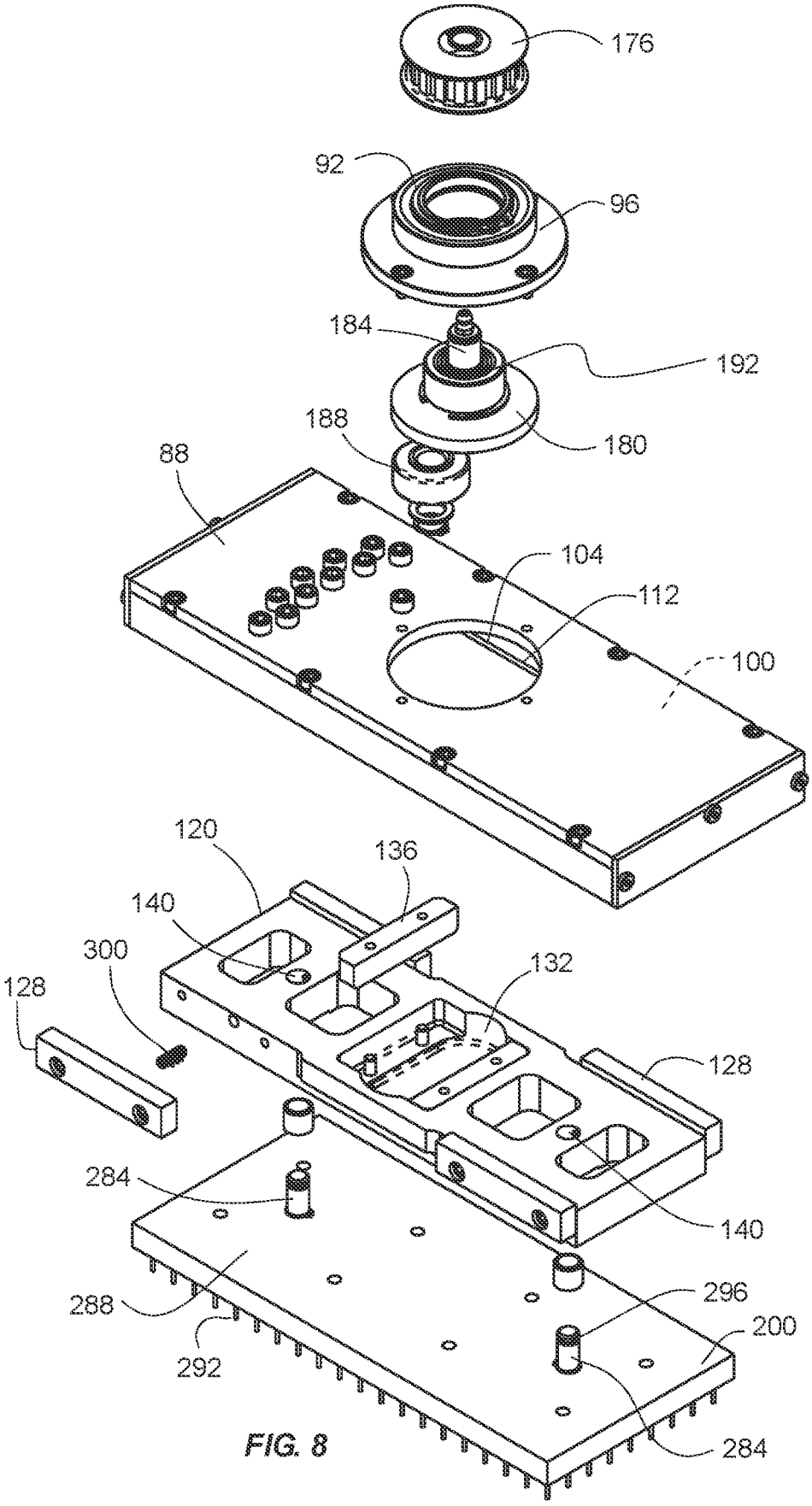
FIG. 8 is an exploded view of an example head of the cleaning machine of FIG. 1 in accordance with one embodiment.

A head 88 can be carried by the extension arm 80 and located at the distal end 84 of the extension arm 80. In one aspect, the head 88 can be pivotally coupled to the extension arm 80 and pivotal in a horizontal plane parallel with the support surface and the floor 14 and a vertical axis. The head 88 can be pivotally coupled to the extension arm 80 by a bearing 92 coupled to the head 88 by a bearing housing 96, as shown in FIG. 8. The extension arm 80 and the head 88 can have a horizontal length L from the base 18 and the housing 30 to a distal end of the head 88 that is greater than 20 inches in one aspect, and substantially 24 inches in another aspect. Thus, the head 88 can reach underneath equipment, such as gondolas, counters, displays, shelves and tables. In another aspect, the extension arm 80 can have a multiple and/or variable lengths to accommodate the use conditions. For example, a shorter extension arm can be used in retail situations in which a shelf may be accessible from both sides. In another example, a longer extension arm can be used in kitchen or cafeteria situations in which equipment may be accessible from one side. The extension arm 80 can have a fixed length with a proximal end that is selectively coupled to the base 18. For example, the proximal end of the extension arm 80 can have fastener slots to receive fasteners through the fastener slots and into the base 18 to secure the extension arm 80 to the base 18. The fastener slots can allow the extension arm 80 to be selectively extended from the base 18. In addition, an access slot can be provided to accommodate the motor 38, and the shaft and/or pulley/gear of the motor 38. In another aspect, multiple different extension arms with different length can be utilized to achieve the desired length for the use conditions.

Referring to FIGS. 1, 2 and 7-15, the head 88 can have a cavity 100 with a rail or track 104 therein and a downward-facing opening 108 facing the support surface and the floor 14. The head 88 and the cavity 100 can be elongated. The rail or track 104 can include a pair of opposite lips 112 along opposite sides of the opening 108 to the cavity 100. The head 88 can have a top or top plate, lateral side walls with the lips 112 at the lower edges, and end plates that can form the cavity 100.

A shuttle 120 can be carried by the head 88 and located in the cavity 100. The shuttle 120 can be positioned on the rail or track 104 and the opposite lips 112. The shuttle 120 can be movably positioned (indicated by arrow 124) in the cavity 100 and on the rail or track 104 to reciprocate. The shuttle 120 can reciprocate along a linear axis (also indicated by arrow 124). The shuttle 120 can be operatively coupled to the motor 18 as described herein.

The shuttle 120 can slide on top of the opposite lips 112. In addition, the opposite of lips 112 can retain the shuttle 120 in the cavity 100 and resist the shuttle 120 from exiting the opening 108. The shuttle 120 can have wear strips 128 (FIG.

8) on opposite sides of the shuttle 120. The wear strips 128 can be positioned to ride on the opposite lips 112. In addition, the wear strips 128 can be positioned between lateral sides of the shuttle 120 and opposing sides of the cavity 100. In one aspect, the wear strips 128 can be sacrificial and replaceable. The wear strips 128 can be formed of a different material than the shuttle 120 and the head 88. For example, the shuttle 120 and the head 88 can be formed of metal, such as aluminum, while the wear strips 128 can be formed of a polymer or plastic.

In addition, the shuttle 120 can have a pocket 132 that is open upwardly. A pair of cam blocks 136 (FIG. 8) can be positioned on opposite sides of the pocket 132. In one aspect, the cam blocks 136 can be sacrificial and replaceable. The cam blocks 136 can be formed of a different material than the shuttle. For example, the cam blocks 136 can be formed of a polymer or plastic.

Furthermore, the shuttle 120 can have a pair of bores 140. The bores 140 can be vertically oriented and spaced-apart from one another.

Figure 7:
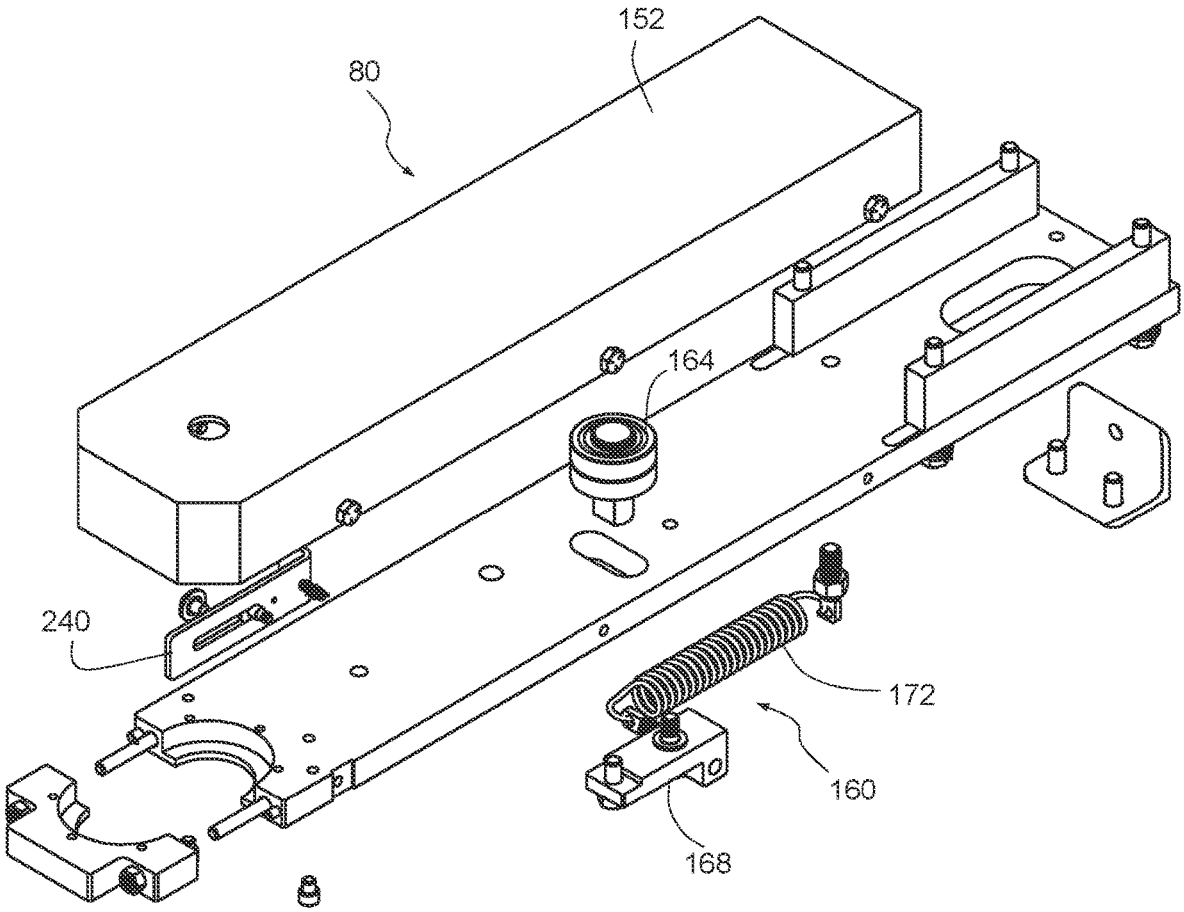
FIG. 7 is an exploded view of an example extension arm of the cleaning machine of FIG. 1 in accordance with one embodiment.

In one aspect, the shuttle 120 can be coupled to the motor 18 by a belt drive system 144 with a toothed belt 148. The belt 148 can extend from the motor 18, along the extension arm 80, to the head 88 and the shuttle 120. A belt cover 152 can cover the belt 148 and be coupled to the extension arm 80 forming a cavity or beltway 156. In another aspect, the belt cover 152 can form part of the extension arm 80 and can also form the low-profile of the extension arm. Thus, description of the low-profile of the extension arm 80 also applies to the belt cover 152 of the extension arm 80. In one aspect, the belt cover 152 can have multiple portions to accommodate a variable length of the extension arm 80. In another aspect, multiple different belt covers with different length can be available to accommodate the length of the extension arm 80. The belt drive 144 can have an automatic belt tensioner 160 (FIG. 7). The belt tensioner 160 can comprise a bearing 164 or pair of stacked bearings that can bear against the belt 148 and carried by a pivotal arm 168 that can bias the bearing 164 and the arm 168 towards the belt 148 with a spring 172.

A toothed pulley 176 can be rotationally mounted at the distal end 84 of the extension arm 88. The toothed pulley 176 can be engaged and driven by the toothed belt 148.

A crank 180 can be carried by the head 88 and operatively coupled between the motor 18 and the shuttle 120. The crank 180 can be coupled to and rotational with the toothed pulley 176. A spindle 184 of the crank 180 can be coupled to the toothed pulley 176. The crank 180 can rotate about a rotational axis defined by the spindle 184. An offset orbital bearing 188 can be rotatably coupled to the crank 180 opposite the spindle 184 and off-center or offset from the rotational axis and the spindle 184. Thus, as the belt 148 rotates the toothed pulley 176 and the crank 180, the orbital bearing 188 can orbit around the rotational axis. The orbital bearing 188 can be positioned in the pocket 132 of the shuttle 120. As the orbital bearing 188 orbits the rotational axis, the orbital bearing 188 can engage the shuttle 120 and drive and reciprocate the shuttle 120 back-and-forth in linear motion (also indicated by arrow 124). The orbital bearing 188 can bear against the cam blocks 136 in the pocket 132 of the shuttle 120. In one aspect, the crank 180 can have a plate coupled to the spindle 184 and a post extending from the plate off-center or off-axis from the spindle 184. The orbital bearing 188 can be rotatably coupled to the post by a bearing. In another aspect, the plate can have voids adjacent to the post and in the same hemisphere of the plate as the post to provide balance to the crank 180 as it rotates.

A crank bearing 192 can be positioned between the spindle 184 of the crank 180 and the bearing housing 96 coupled to the head 88. In one aspect, the crank bearing 192 can be adapted for both: 1) radial and horizontal loads (indicated by the x-axis and the y-axis), and 2) axial and or vertical loads (indicated by the z-axis). The radial or horizontal loads can be applied by rotation of the crank 180 and the reciprocal motion of the shuttle 120. The axial or vertical loads can be applied by the shuttle 120 (and the weight of the machine 10 against the scrub pad 200, described below). In another aspect, the crank bearing 192 can be an angular-contact bearing.

A scrub pad 200 can be coupled to the shuttle 120. The scrub pad 200 can be reciprocated by the shuttle 120. The scrub pad 200 can be coupled to the shuttle 120 through the opening 108 in the head 88. The scrub pad 200 can be positioned underneath the head 88 and to bear against the support surface and the floor 14. Thus, the weight of the machine 10 can be carried by the pair of wheels 22 under the rear of the base 18, and the scrub pad 200 at the distal end 84 of the extension arm 80.

Figure 16:
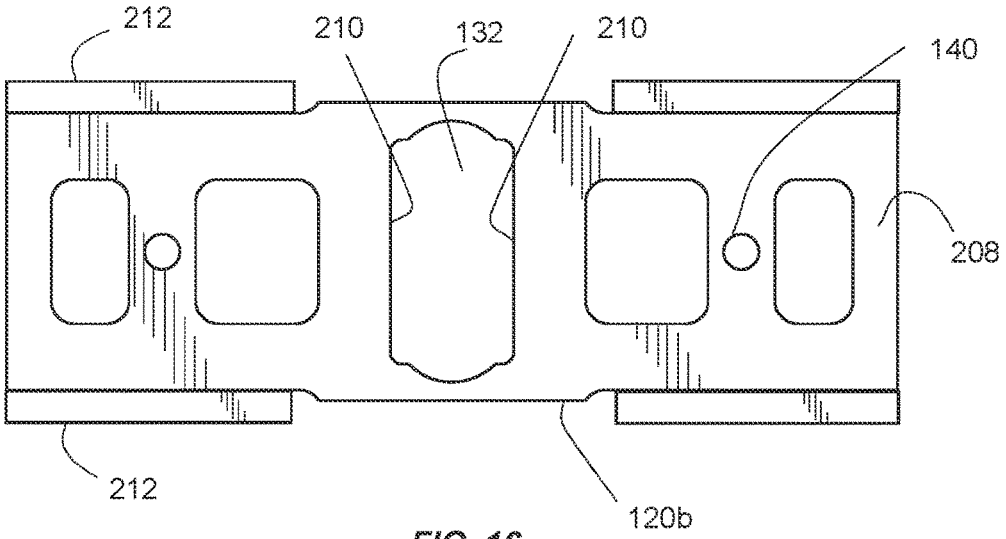
FIG. 16 is a top view of another example shuttle block of a cleaning machine in accordance with one example.
Figure 17:
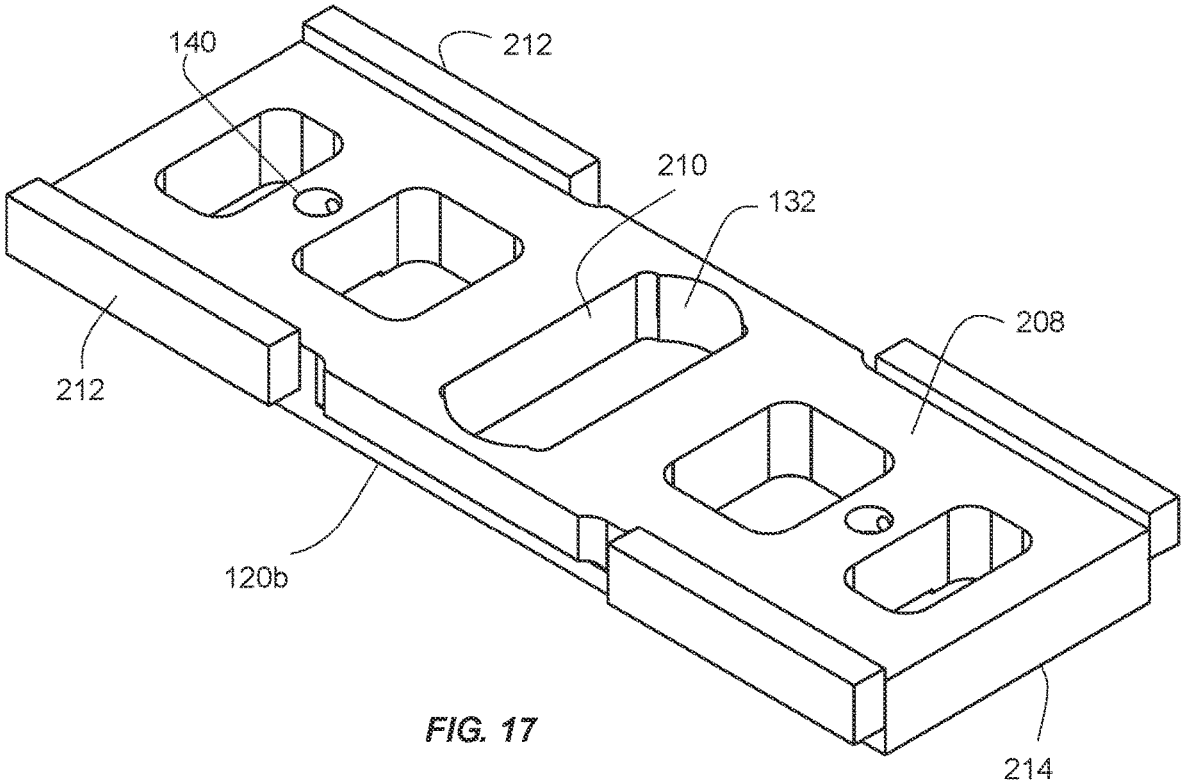
FIG. 17 is a perspective view of the shuttle block of FIG. 16.
Figure 18A:
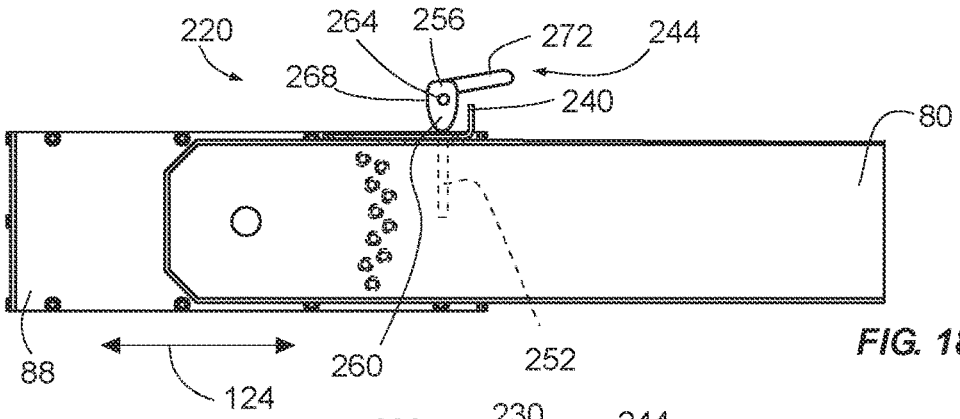
FIG. 18A-E are top views of the head and the extension arm of the cleaning machine of FIG. 1, shown with the head in multiple orientations with respect to the extension arm.
Figure 18B:
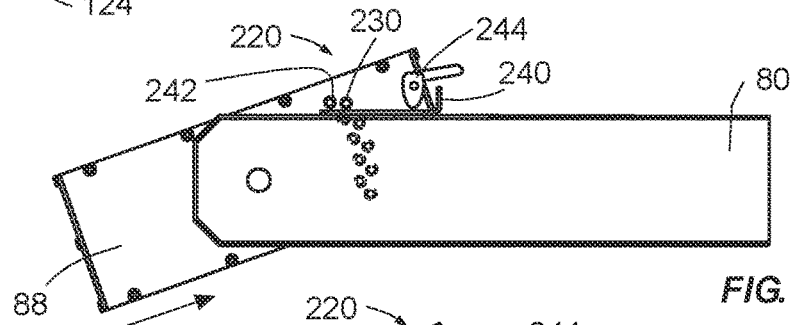
Figure 18C:
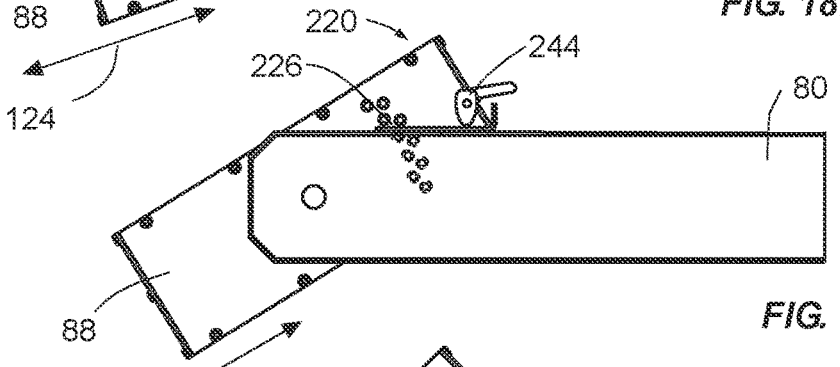
Figure 18D:
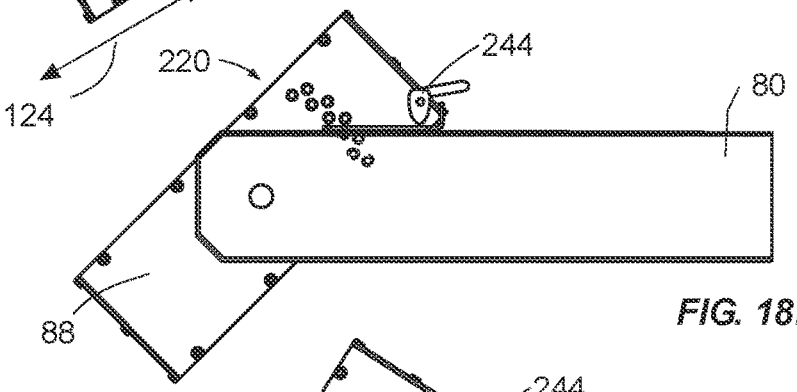
Figure 18E:
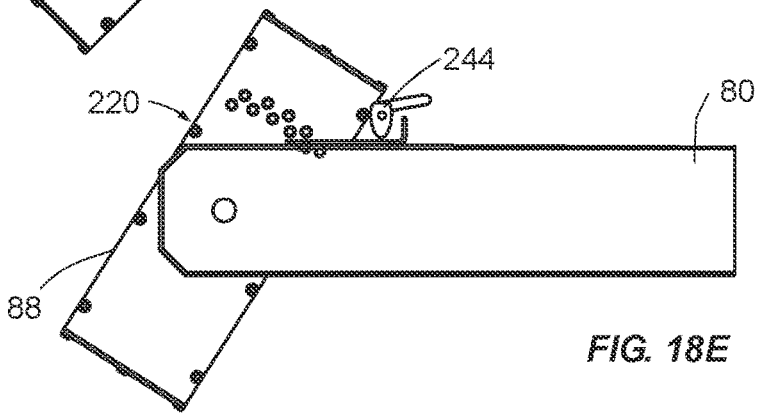

Referring to FIGS. 16 and 17, another shuttle **120*b* is shown that is similar in many respects to that described above. In one aspect, the shuttle 120*b* can further comprise a solid polymer block 208. For example, the solid polymer block 208 can form a majority of the shuttle 120*b*. As another example, the solid polymer block 208 can form the entire shuttle 120*b*. The solid polymer block 208 can have the pocket 132 to receive the offset orbital bearing 188. The pocket 132 of the solid polymer block 208 can have at least opposing walls 210 of polymer engaged by the offset orbital bearing 188. Thus, the solid polymer block 208 can perform the function of the cam blocks 136 described above. The block 208 of the shuttle 120*b* can have opposite lateral walls 212 of polymer engaging opposing sides of the cavity 100 of the head 88. Thus, the solid polymer block 208 can perform the function of the wear strips 128. The block 208 can have a bottom wall 214 of polymer engaging the rail 104 of the head 88. The block 208 can be solid between the opposing walls 210 of the pocket 132, the opposite lateral walls 212 of the block 208 and the bottom wall 214 of the block 208. The solid polymer block 208 of the shuttle 120*b* can reduce parts by eliminating the cam blocks 136 and the wear strips 128 described with respect to the shuttle 120**.

As described above, the head 88 can be pivotally coupled to the distal end 84 of the extension arm 80. In one aspect, the head 88 can be selectively pivotal in a horizontal plane about a vertical axis. In another aspect, the head 88 can have at least two different rotational orientations with respect to the extension arm 80. Thus, the head 88 can be pivoted to selectively orient the linear axis 124 with respect to the extension arm 80. Selectively orienting the head 88 and the linear axis 124 with respect to the extension arm 80 can allow the machine 10 to be oriented with respect to various structures, such as walls, baseboards, and equipment.

Figure 9:
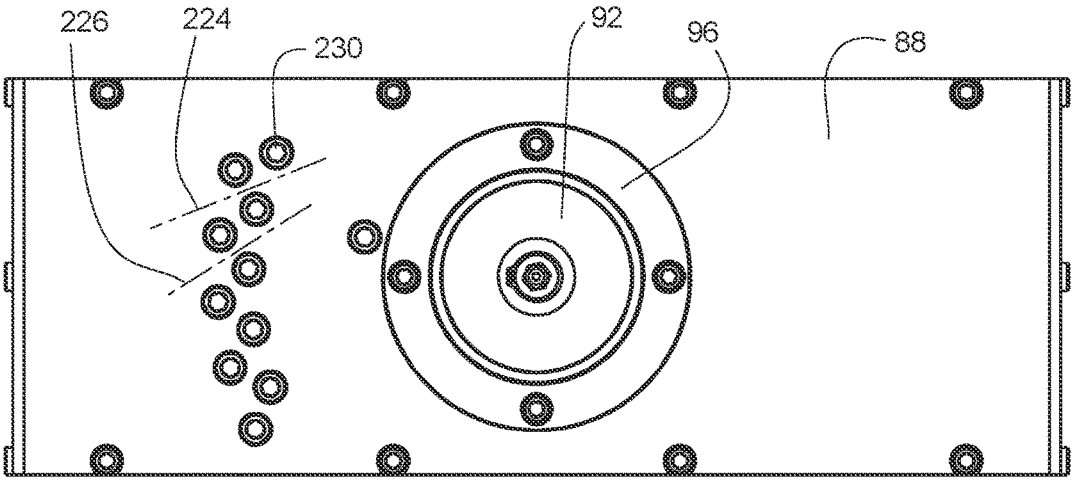
FIG. 9 is a top view of the head of the cleaning machine of FIG. 1.
Figure 10:
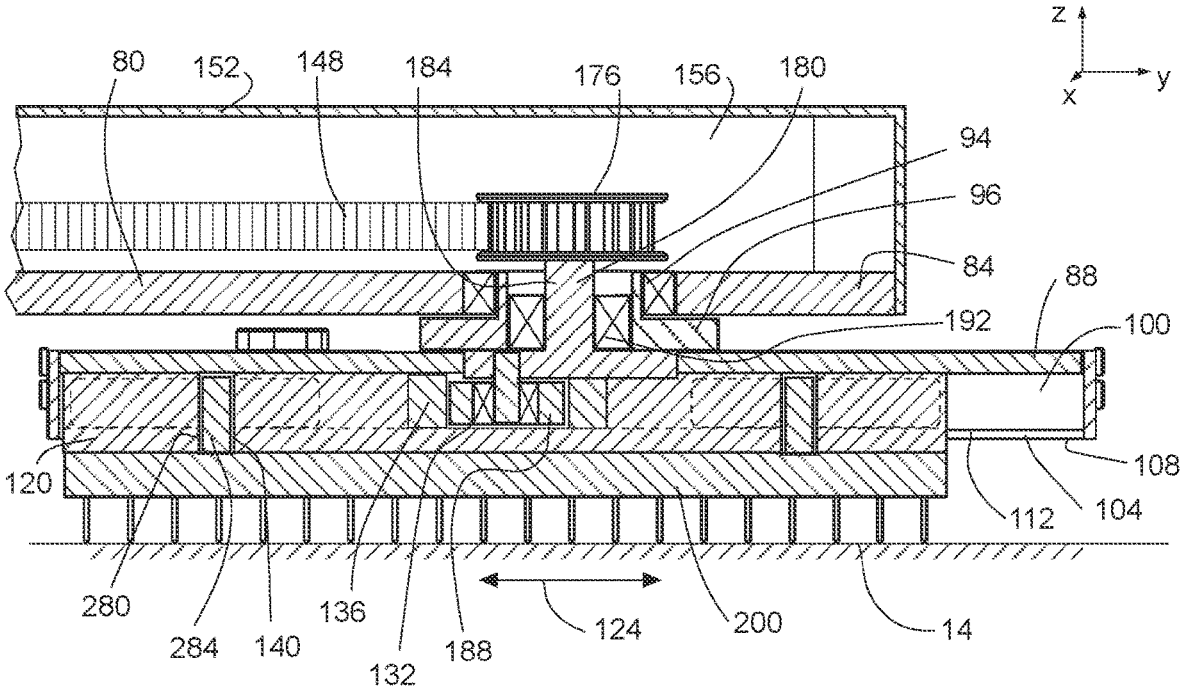
FIG. 10 is a partial cross-sectional side view of the head and the extension arm of the cleaning machine of FIG. 1.
Figure 19:
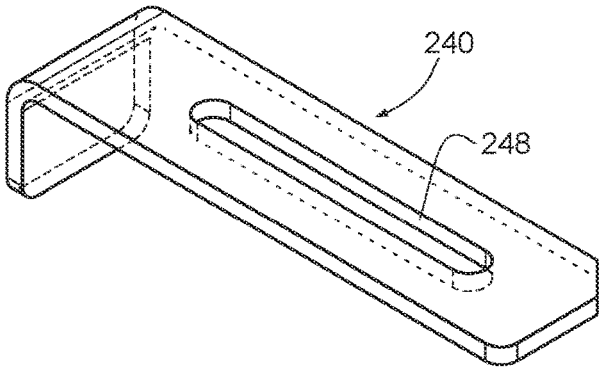
FIG. 19 is a perspective view of an example slide lock of the cleaning machine in FIG. 1.
Figure 11:
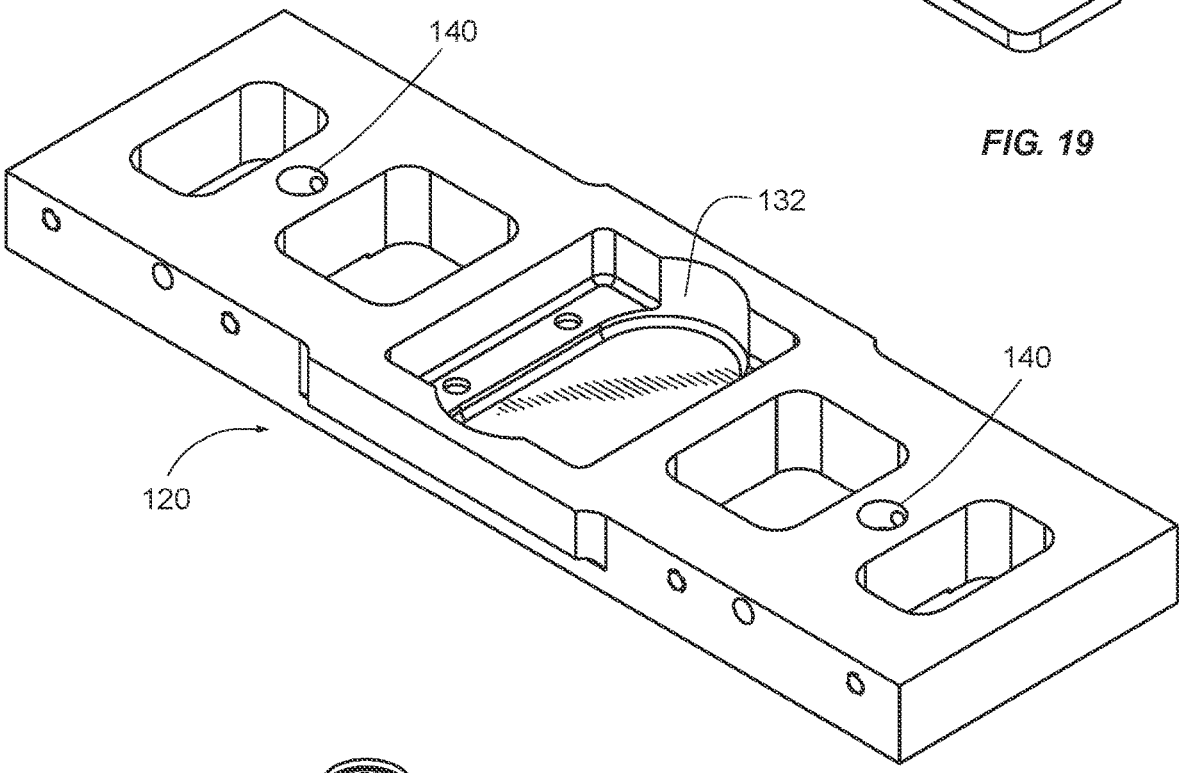
FIG. 11 is a perspective view of an example shuttle of the cleaning machine of FIG. 1.
Figure 12:
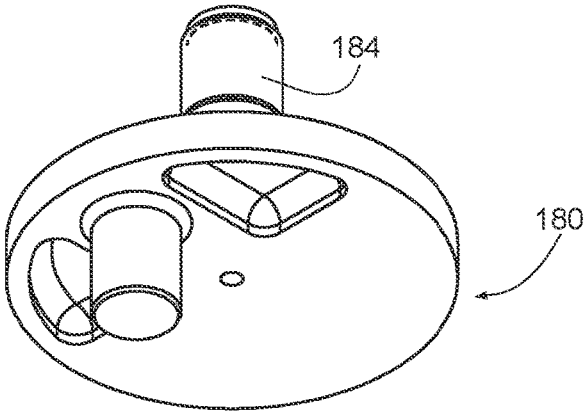
FIG. 12 is a perspective view of an example crank of the cleaning machine of FIG. 1.
Figure 13:
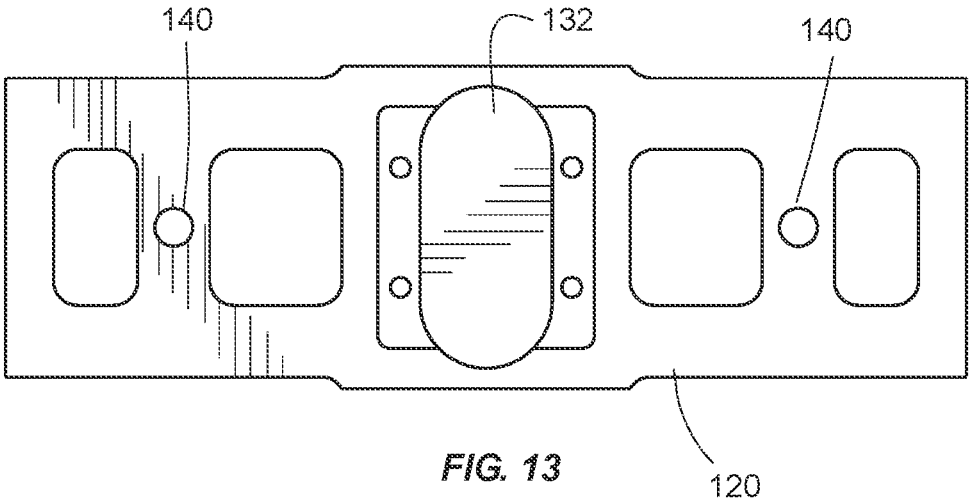
FIG. 13 is a top view of the shuttle of the cleaning machine of FIG. 1.
Figure 14:
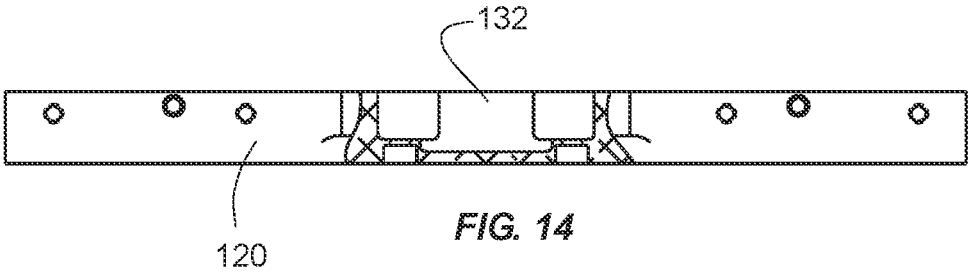
FIG. 14 is a side view, partially broken away, of the shuttle of the cleaning machine of FIG. 1.
Figure 15:
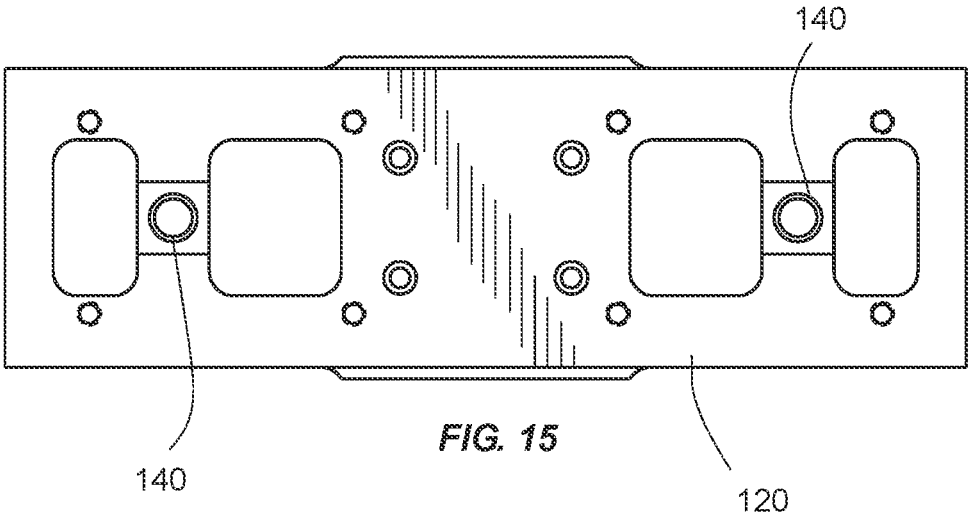
FIG. 15 is a bottom view of the shuttle of the cleaning machine of FIG. 1.

Referring to FIGS. 9, 18 and 19, in one aspect, the head 88 can be selectively locked in one of the at least two different rotational orientations by a lock 220. The head 88 and the linear axis 124 of reciprocation of the shuttle 200 can be selectively oriented with respect to the extension arm 80 and locked into place. The head 88 and the linear axis 124 of reciprocation of the shuttle 200 can be oriented parallel and coaxial with the extension arm 80, as shown in A of FIG. 18. In addition, the head 88 and the linear axis 124 of reciprocation of the shuttle 200 can be oriented transverse with respect to the extension arm 80, as shown in B-E of FIG. 18. As shown in FIG. 18, the head 88 and the linear axis 124 of reciprocation of the shuttle 200 can have five different orientations with respect to the extension arm 80 to accommodate equipment and/or situations.

The lock 220 can have at least a pair of slots 224 and 226 associated with the head 88 (FIG. 9) and corresponding to the at least two different rotational orientations. In one aspect, the slots 224 and 226 can be formed by heads 230 of fasteners arranged on a top of the head 88. The heads 230 and the fasteners can be radially arrayed on the head 88 to form a radial array of slots 224 and 226, each corresponding to a different rotational orientation of the head 88 with respect to the extension arm 80. A pair of heads 230 of the fasteners can form one slide of one slot 224 and another side of a proximate slot 226. Each slot 224 and 226 can have a pair of heads 230 of the fasteners on one side and another pair of heads 230 of the fasteners on the other side.

In addition, the lock 220 can have a slide 240 slidably coupled to the extension arm 80. The slide 240 can be selectively positioned in one of the pair of slots 224 and 226. Thus, the slide 240 residing in one of the slots 224 and 226 can fix the orientation of the head 88 with respect to the extension arm 80. In one aspect, the slide 240 can be coupled to the belt cover 152. Thus, the slide 240 is coupled to the extension arm 80 via the belt cover 152.

In one aspect, the lock 220 can have a quick-release 244 coupling the slide 240 to the extension arm 80. The quick-release 244 can have a tight position fixing the slide 240 to the extension arm 80 and the belt cover 152, and a loose position allowing the slide 240 to slide with respect to the extension arm 80 and the belt cover 152.

In another aspect, the quick-release 244 can include a lock slot 248 (FIG. 19) in the slide 240. A rod 252 can extend through the lock slot 248 to the extension arm 80. The rod 252 can be a threaded rod. A cam 256 can be carried by the rod 252 and pivotal on the rod 252. The cam 256 can have a nose 260 that is thicker from a pivot 264 of the cam 256 to press the slide 240 against the extension arm 80 and the belt cover 152 in the tight position. In addition, the cam 256 can have a heel 268 that is thinner from the pivot 264 of the cam 256 to release the slide 240 from the extension arm 80 and the belt cover 152 in the loose position. A tab 272 can extend from the cam 256 to facilitate moving the cam 256 between the tight and loose positions.

In another aspect, the machine 10 can have a plurality of different pads 200 separately coupleable to the shuttle 120. The scrub pads 200 can have different surface textures and/or materials for use with different flooring surfaces and/or cleaning situations. For example, the plurality of different pads or drivers can include: a standard pad, a low-profile pad, a multi-purpose pad, a baseboard and floor edge pad, a brush pad for grout, a carpet glue removal pad with wire bristles, a tooling for polish concrete, and a tooling for burnishing concrete.

Referring again to FIGS. 8, 10 and 11, the pads 200 can be quickly and easily mounted to the shuttle 120 and quickly and easily interchanged. In another aspect, the machine 10, the head 88 and the shuttle 120 can have a snap-fit connection 280 between the shuttle 120 and each of the scrub pads 200. The snap-fit 280 can include a pair of pins 284 extending from each of the plurality of scrub pads 200. The scrub pads 200 can have a solid backing plate 288 (FIG. 8). The backing plate 288 can support a working material 292 or mat, such as course fiber, on the lower side, and the pins 284 on the upper side. The pins 284 can have a groove 296 circumscribing the pin 284 at a distal end of the pin 284. The pair of pins 284 can be selectively received in the pair of bores 140 in the shuttle 120. A detent 300 (FIG. 8) can be positioned in each of the pair of bores 140. The detents 300 can engage with a respective groove 296 in a respective pin 284. The detents 300 can be biased into the bore 140 from a lateral side of the bore 140, such as with a spring. Thus, a pad 200 can be selectively coupled to the shuttle 120 by pressing the pins 284 into the bores 140. The detent 300 can be displaced away from the bore 140 by the pin 284 as the pin 284 is inserted; and the detent 300 can be displaced back towards the pin 240 and into the groove 296 by the spring when the groove 296 is aligned with the detent 300. Similarly, the pad 200 can be selectively removed from the shuttle 120 by pulling the pad 200 away from the shuttle 120 and pulling the pins 284 from the bores 140.

Figure 20:
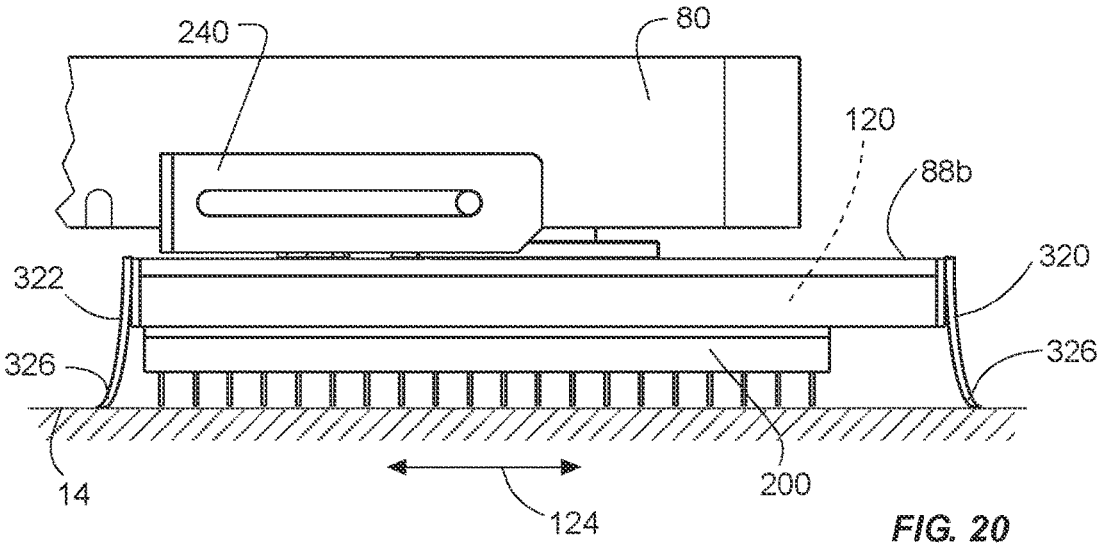
FIG. 20 is a partial side view of an example head and the extension arm of a cleaning machine in accordance with one embodiment.

In one aspect, the machine 10 and the pad can be used dry. In another aspect, the machine 10 and the pad 200 can be used with a liquid, such as a cleaning solution or chemical, that can be applied to the floor 14 and agitated against the floor by the pad 200. Referring to FIG. 20, in another aspect, the machine 10 and the head 88*b* can have a splash guard 320 and 322 to resist splashing the liquid beyond the head 88*b* and onto the machine 10 or proximate surfaces. The splash guard 320 and 322 can be carried by the head 88*b* and positioned at least on opposite ends of the head 88*b* transverse to the linear axis 124 of the shuttle 120. Thus, the splash guard 320 and 322 can be a pair of opposite splash guards 320 and 322 at the ends of the head 88*b* to leave lateral sides of the head 88*b* open to circulate the liquid. The splash guard 320 and 322 can have a height extending from the head 88*b* to at least a distal bottom end of the scrub pad 200, and thus the floor 14. In another aspect, the splash guard 320 and 322 can be flexible and resilient to conform to contours in the floor 14. In another aspect, the splash guard 320 and 322 can have a height greater than a distance from a bottom of the head 88*b* to the bottom of the scrub pad 200 and can form an arcuate spring between the floor 14 and the 88*b* head to press a distal edge 326 of the splash guard 320 and 322 against the floor 14.

Figure 21:
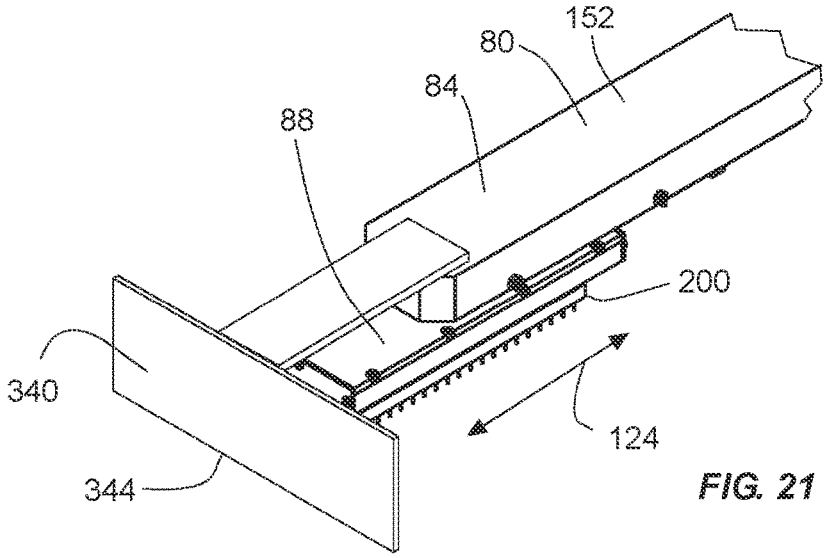
FIG. 21 is a partial perspective view of an example extension arm of a cleaning machine in accordance with one embodiment.

Referring to FIG. 21, in another aspect, the machine 10 can have a squeegee 340 carried by the extension arm 80. The squeegee 340 can have a resilient edge 344 positioned substantially flush with a distal bottom end of the scrub pad 200, and thus the floor 14. The squeegee 340 can direct fluid on the floor 14 towards the pad 200, and can maintain fluid adjacent the pad 200 to be used by the pad 200 against the floor 14. In one aspect, the squeegee 340 can be positioned forward of the head 88. The squeegee 340 can be aligned transverse or perpendicular with respect to the extension arm 80. Thus, an operator of the machine 10 can push and/or pull the machine 10 to use the squeegee 340. In another aspect, the squeegee 340 can be flexible and resilient to conform to contours in the floor 14. In another aspect, the squeegee 340 can form an arcuate spring between the floor 14 and the extension arm 8—to press a distal edge 344 of the squeegee 340 against the floor 14.

Figure 22:
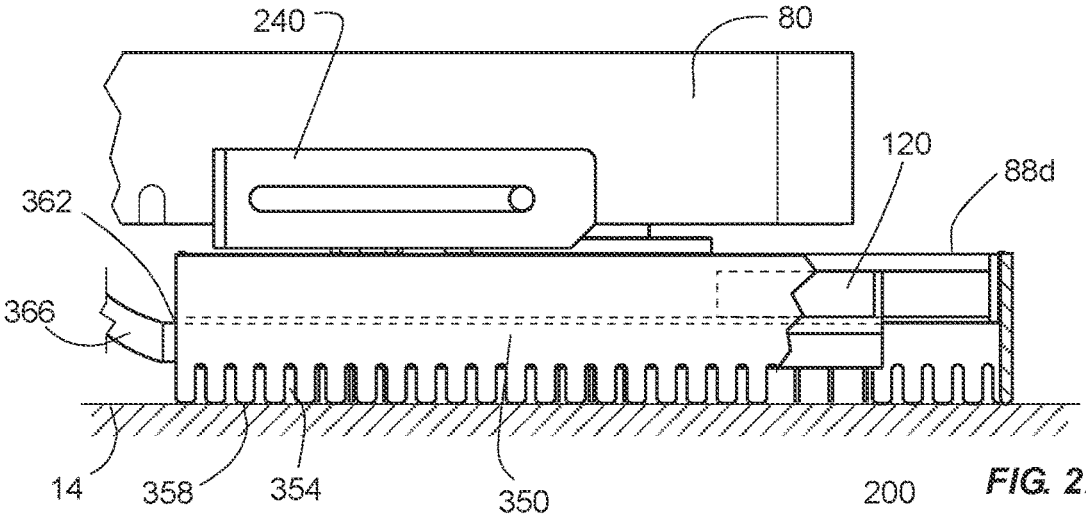
FIG. 22 is partial side view, partially broken away, of an example head of a cleaning machine in accordance with one embodiment.
Figure 23:
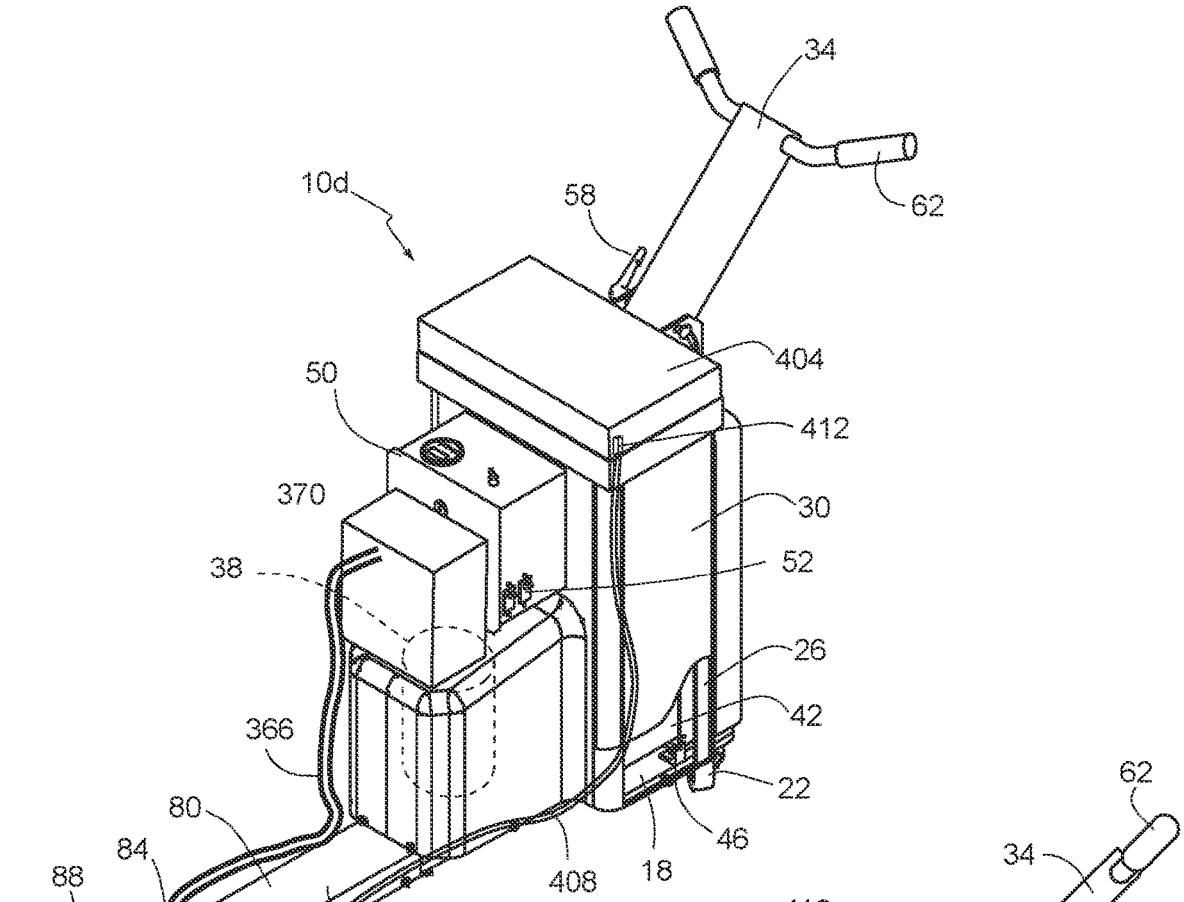
FIG. 23 is a perspective view, partially broken away, of another example floor cleaning machine in accordance with another embodiment.
Figure 24:
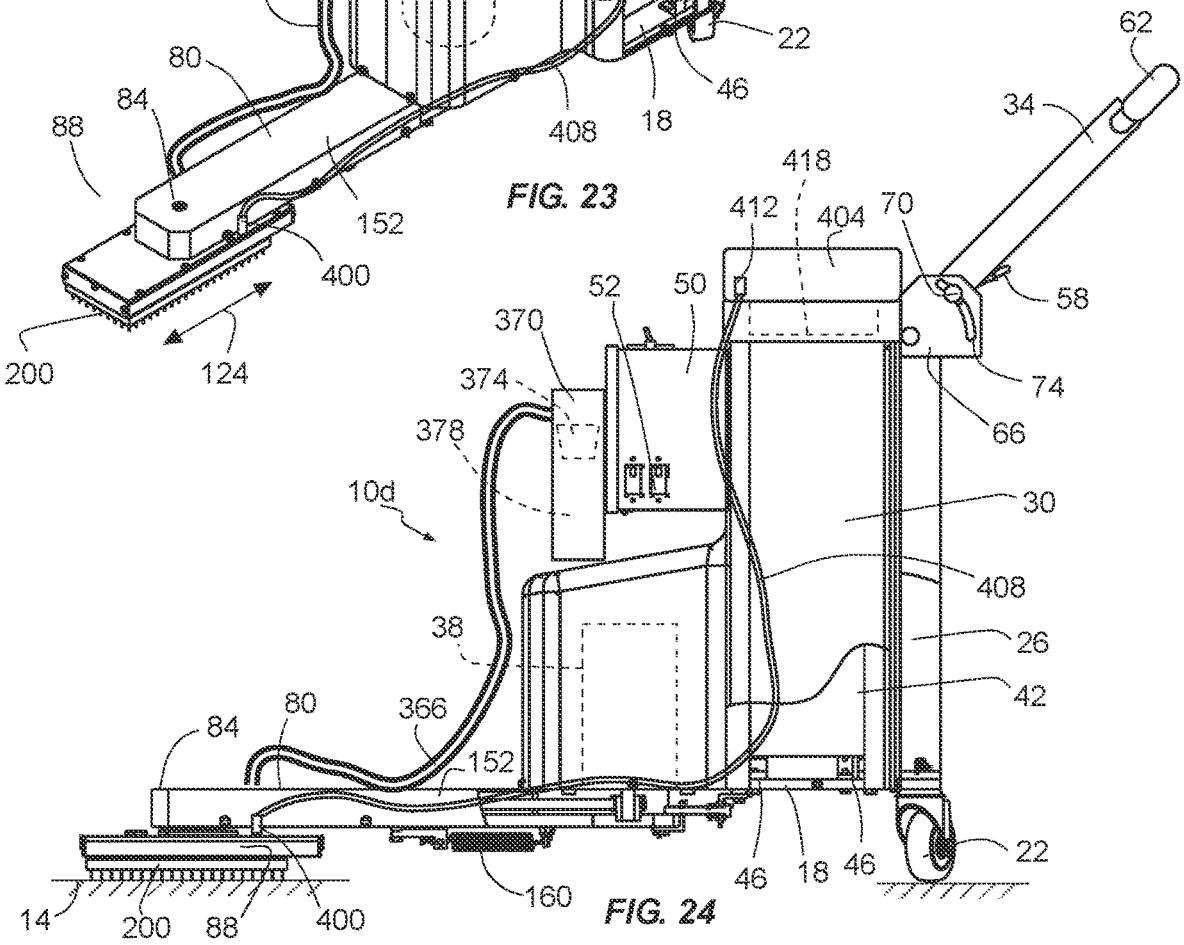
FIG. 24 is a side view, partially broken away, of the floor cleaning machine of FIG. 23.

The machine 10*d* may create dust depending on the pad 200 used and the material of the floor 14. For example, the pad can have an abrasive working surface that can be used on a wood floor. Referring to FIGS. 22-24, in another aspect, the machine 10*d* and the head 88*d* can have a shroud 350 or a skirt carried by the head 88*d* and circumscribing the head 88*d*. In one aspect, the shroud 350 can extend around a lateral perimeter of the entire head 88*d*. The shroud 350 can have a height extending from the head 88*d* to at least a distal bottom end of the scrub pad 200, and thus the floor 14. In one aspect, the shroud 350 can be rigid. In another aspect, the shroud 350 can have an array of notches 354 in a bottom edge 358 of the shroud 350. A port 362 can be associated with the shroud 350. For example, the port 362 can extend through the shroud 350. A hose 366 can be coupled to the port 362 of the shroud 350. A vacuum source 370 can be carried by the base 18, the frame 26 or the housing 30, and coupled to the hose 366. The vacuum source 370 can apply a negative pressure source to a volume defined under the pad 200, above the floor 14 and within the shroud 350. An air stream can be formed through the array of notches 354, under the pad 200, and out through the port 362. The air stream can carry particles to the vacuum source 370. The vacuum source can have a filter 374 and or chamber 378 to retain the particles.

As described above, the machine 10*d* and the pad 200 can be utilized with a liquid. The machine 10*d* can be configured to apply the liquid to the floor 14 adjacent the head 88 and the pad 200. Referring to FIGS. 23 and 24, in one aspect, the machine 10*d* and the head 88 can have a nozzle 400 positioned near the head 88. In one aspect, the nozzle 400 can be coupled to and carried by the head 88. In another aspect, the nozzle 400 can be coupled to and carried by the distal end 84 of the extension arm 80 adjacent to the head 88. A solution tank 404 can be carried by the base 18, the frame 26 and/or the housing 30. The solution tank 404 can hold the liquid, such as a cleaning liquid. A tube 408 can extend between the solution tank 404 and the nozzle 400. A valve 412 can be coupled in the tube 408 and positioned near the handle 34 to selectively open and close. The valve 412 can selectively dispense the liquid from the nozzle 400 adjacent to the head 88. In one aspect, the housing 30 can have an upper cavity 416 (FIG. 1). The solution tank 404 can nest in the upper cavity of the housing 30. For example, the solution tank 404 can have a protrusion 418 (FIG. 24) matching and mating with the upper cavity.

Figure 25:
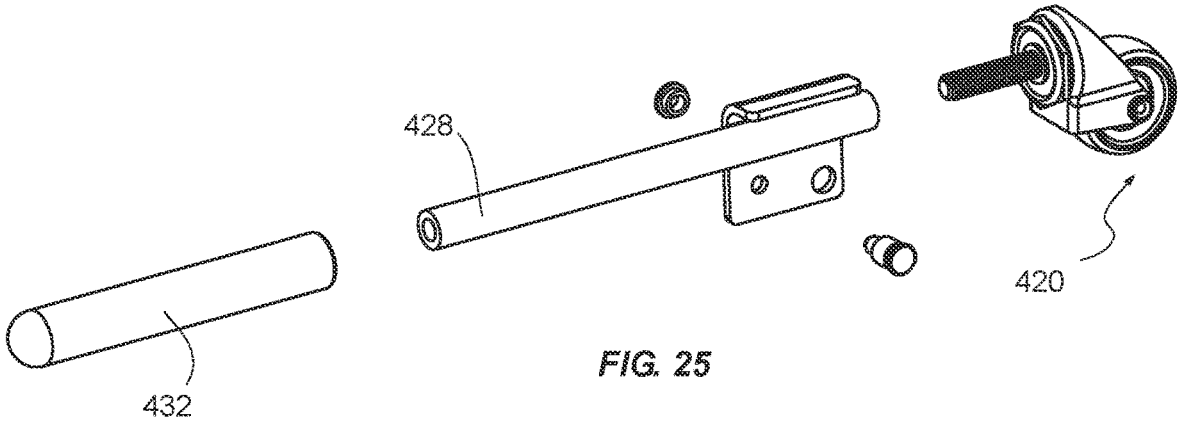
FIG. 25 is an exploded view of an example transport wheel of the cleaning machine of FIG. 1 in accordance with one example.
Figure 26A:
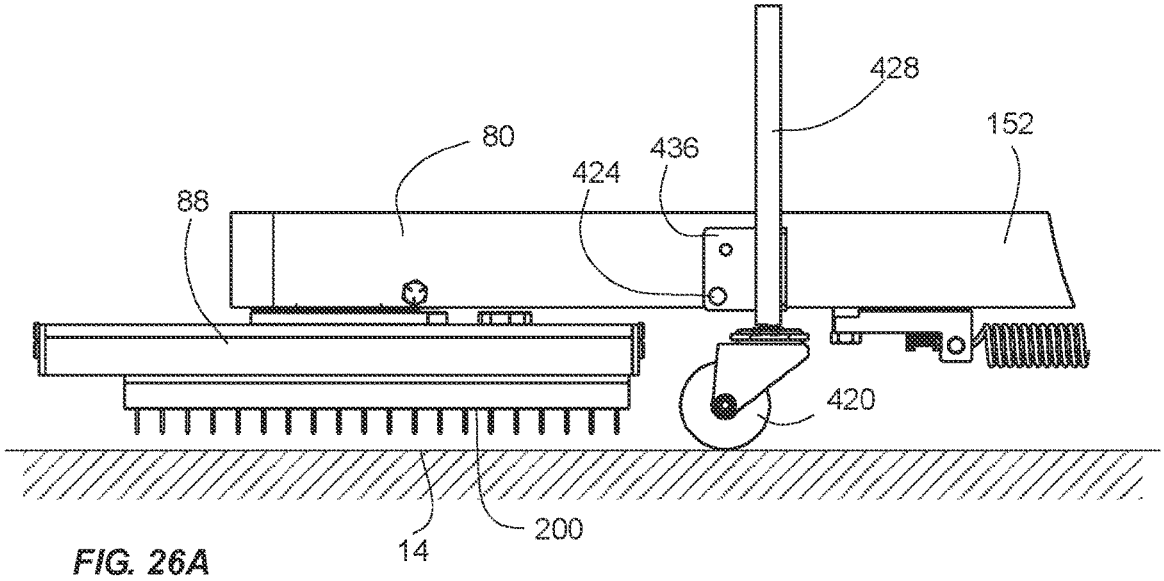
FIG. 26A is a partial side view of the extension arm and the transport wheel of FIG. 25, shown with the transport wheel in a deployed configuration.
Figure 26B:
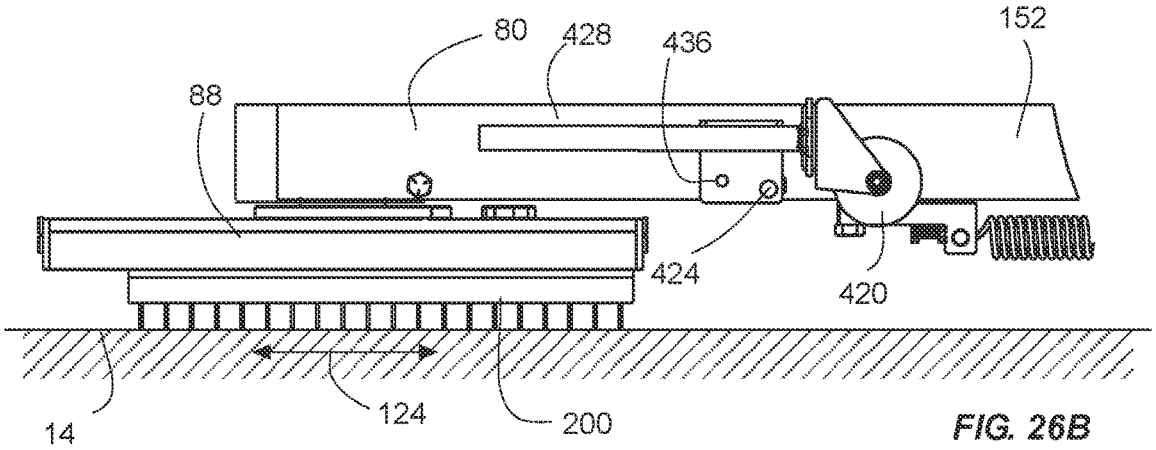
FIG. 26B is a partial side view of the extension arm and the transport wheel of FIG. 25, shown with the transport wheel in a retracted configuration.

During use, the machine 10 can be supported on the floor 14 by the pair of wheels 22 in the back of the base 18, and the pad 200 on the distal end 84 of the extension arm 80. To transport the machine 10 between uses, the machine 10 can be tilted back on the pair of wheels 22 to elevate the pad 200 off of the floor 14. Referring to FIGS. 25, 26A and 26B, in another aspect, the machine 10 can have a transport wheel 420 that can be selectively deployed to facilitate transporting the machine 10. During transport, the machine 10 can be supported on the floor by the pair of wheels 22 in the back of the base 18 and the transport wheel 420. The transport wheel 420 can be coupled to and carried by the extension arm 80. The transport wheel 420 can be pivotally coupled to the extension arm 80 and the belt cover 152 at a pivot 424. The transport wheel 420 can be pivotal between at least two positions, including a deployed position, as shown in FIG. 26A, and a retracted position, as shown in FIG. 26B. In the deployed position, a bottom-most portion of the wheel 420 can be located below a distal bottom end of the scrub pad 200. Thus, the wheel 420 can elevate the scrub pad 200 from off of the support surface or the floor 14. In the retracted position, the wheel 420 can be elevated with respect to the deployed position and the bottom-most portion of the wheel 420 can be located above the distal bottom end of the scrub pad 200. Thus, the scrub pad 200 can rest on the floor 14.

A lever arm 428 can be coupled to the wheel 420 opposite the pivot 424. The lever arm 428 can have at least two positions, including: a vertical position and a horizontal position. In the vertical position, the lever arm 428 can be substantially vertical. The vertical position can correspond to the deployed position of the wheel 420. The lever arm 428 can be colored, such as red, to draw attention to the deployment of the transport wheel 420 and elevation of the pad 200. The lever arm 428 can have a sleeve 432 to facilitate gripping and that can be colored. In the horizontal position, the lever arm 428 can be substantially horizontal and can be positioned along-side the extension arm 80. The horizontal position can correspond to the retracted position of the wheel 420. In the horizontal position of the lever arm 428 and the retracted position of the transport wheel 420, the lever arm 428 and the transport wheel 420 can be positioned within a profile of the extension arm 88 and the belt cover 152, and below an uppermost part of the extension arm 80 and the belt cover 152 so that the extension arm 80 can be low profile. A locking pin 436 can engage the extension arm 80 and can maintain the orientation of the transport wheel 420.

As described above, the machine 10 can have a rotational electric motor 38 carried by the base 18 and coupled to the reciprocating shuttle 120 by the belt drive 144. In another aspect, the machine can have a motor carried by the distal end of the extension arm. In another aspect, the machine can have a motor carried by the head. Thus, the motor can be located at the distal end of the extension arm and over the shuttle. In addition, the motor can be located within the low-profile of the extension arm 80 and within the vertical height H or elevation less than or equal to 5¼ inches, in one aspect; less than or equal to 4¾ inches, in another aspect; and less than or equal to 3¾ inches in another aspect. Locating the motor at the distal end of the extension arm can eliminate the belt drive, reduce components, and position weight over the pad. In another aspect, the motor can comprise one or more linear actuators. In another aspect, the motor can comprise a permanent magnet linear motor. The linear actuators and the linear motor can provide a lower profile to complement the low-profile extension arm.

Figure 27:
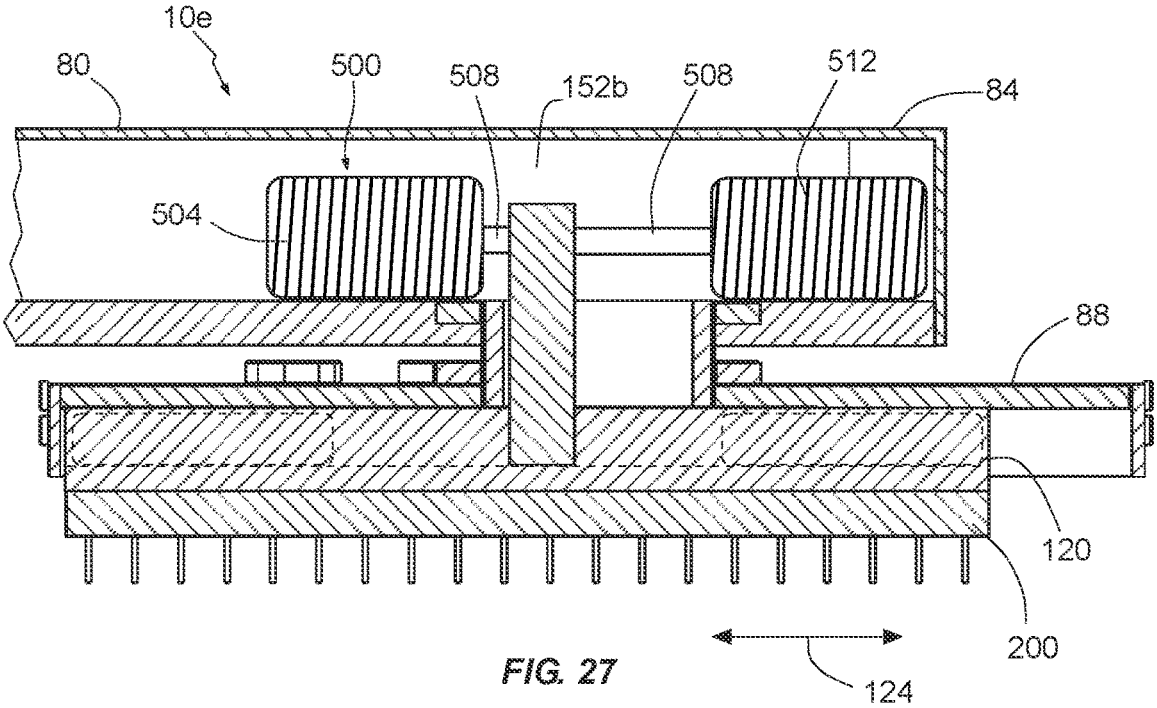
FIG. 27 is a partial cross-sectional side view of an extension arm and a head with an example linear actuator of a cleaning machine in accordance with one embodiment.
Figure 28:
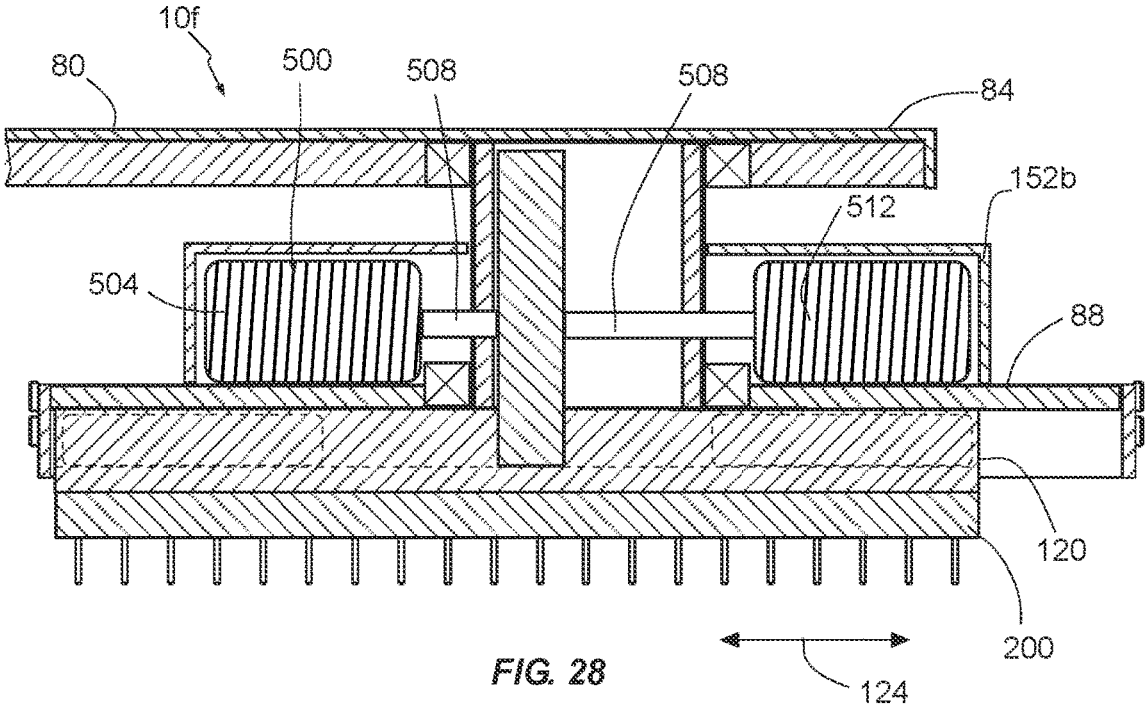
FIG. 28 is a partial cross-sectional side view of an extension arm and a head with an example linear actuator of a cleaning machine in accordance with one embodiment.

Referring to FIGS. 27 and 28, another machine 10*e* and 10*f*, respectively, is shown that is similar in many aspects to the machine 10 described above, and which description is incorporated here. The machine 10*e* and 10*f* can have one or more linear actuators 500 located at the distal end 84 of the extension arm 80. The linear actuator 500 can comprise a coil 504 and a plunger 508 reciprocally disposed in the coil 504. Energizing the linear actuator 500 or applying electricity to the coil 504 can drive the plunger 508 out and/or in with respect to the coil 504. The plunger 508 can be biased in one direction by a spring. Alternately energizing the linear actuator 500 or powering the coil 504 can cause the plunger 508 to reciprocate. In one aspect, the coil 504 can be coupled to and carried by the extension arm 80 or the head 88, while the plunger 508 can be coupled to the shuttle 120. In another aspect, a pair of linear actuators 500 and 512 can be arranged to oppose one another with respect to the shuttle 120 and configured to reciprocally drive the shuttle 120. In one aspect, the linear actuators 500 and 512 can be solenoids. In another aspect, the linear actuators 500 and 512 can be voice coils. The linear actuators 500 and the coils 504 and 512 can be coupled to the battery 42 and control electronics to control and coordinate operation of the coils 504 and 512.

Referring to FIG. 27, the linear actuators 500 and 512 can be carried by the distal end 84 of the extension arm 80. The coils 504 can be coupled to the distal end 84 of the extension arm 80. The linear actuators 500 and 512 can have a profile with an uppermost top at an elevation at least as low as an uppermost top of the extension arm 80 and/or a linear actuator cover 152*b* (similar to the belt cover 152).

Referring to FIG. 28, the linear actuators 500 and 512 can be carried by the head 88. The coils 504 can be coupled to the head 88. The linear actuators 500 and 512 can have a profile with an uppermost top at an elevation at least as low as an uppermost top of the extension arm 88. In another aspect, the linear actuators 500 and 512 can have a profile with an uppermost top at an elevation below the extension arm 88 to allow the head 88 to pivot as described herein. The linear actuator cover 152*b* can be coupled to and carried by the head 88.

Figure 29:
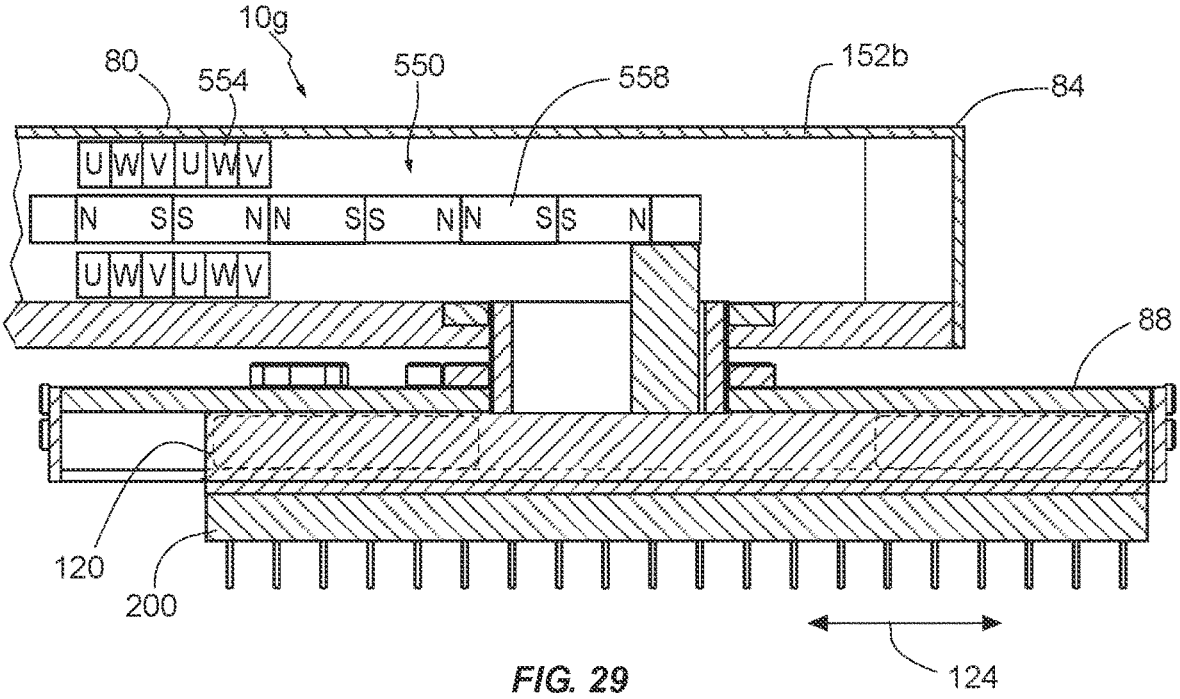
FIG. 29 is a partial cross-sectional side view of an extension arm and a head with an example permanent magnet linear motor of a cleaning machine in accordance with one embodiment.
Figure 30:
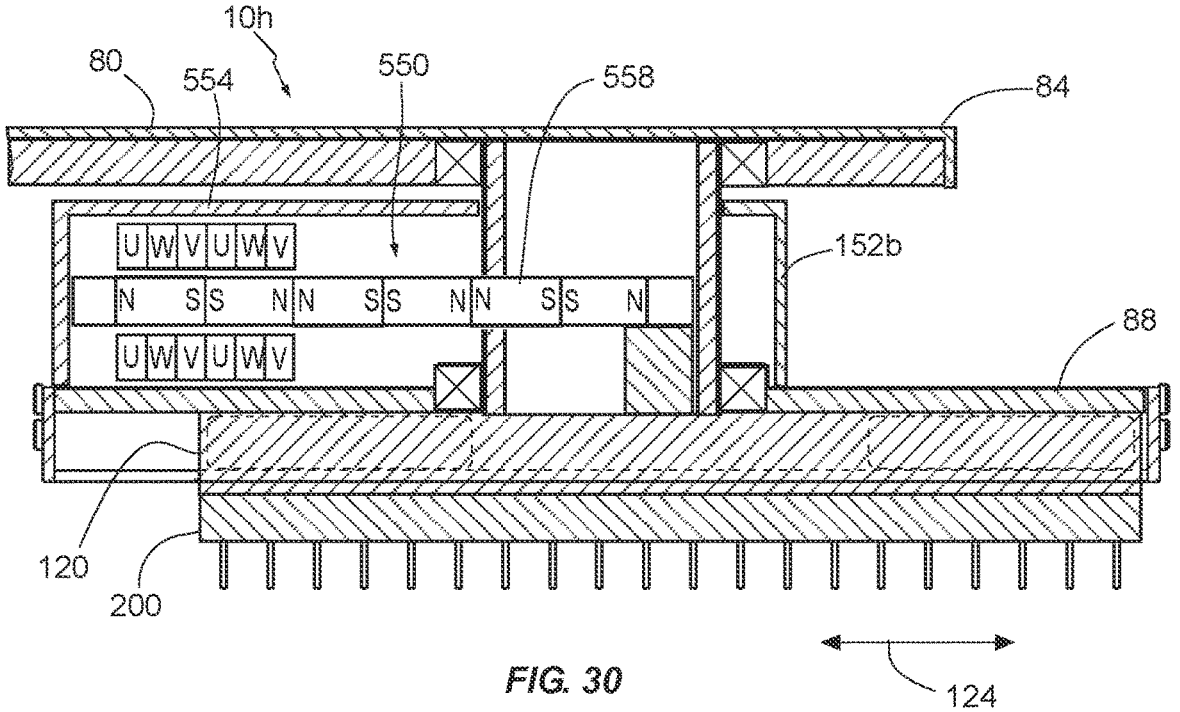
FIG. 30 is a partial cross-sectional side view of an extension arm and a head with an example permanent magnet linear motor of a cleaning machine in accordance with one embodiment.

Referring to FIGS. 29 and 30, another machine 10*g* and 10*h* is shown that is similar in many aspects to the machine described above, and which description is incorporated here. The machine 10*g* and 10*h* can have a permanent magnet linear motor 550 located at the distal end 84 of the extension arm 80. The permanent magnet linear motor 550 can comprise a forcer 554 with electromagnet coils and a shaft 558 movably positioned in the forcer 554 with an array of permanent magnets. Applying electricity to the coils of the forcer 554 can drive the shaft 558 out and/or in with respect to the coils of the forcer 554. Controlling the application of electricity to the coil can cause the shaft 558 to reciprocate. In one aspect, the forcer 554 can be coupled to and carried by the extension arm 80 or the head 88, while the shaft 558 can be coupled to the shuttle 120. The permanent magnet linear motor 550 and the forcer 554 can be coupled to the battery 42 and control electronics to control and coordinate operation of the forcer 554.

Referring to FIG. 29, the permanent magnet linear motor 550 can be carried by the distal end 84 of the extension arm 80. The forcer 554 can be coupled to the distal end 84 of the extension arm 80, while the shaft 558 can be coupled to the shuttle 120. The permanent magnet linear motor 550 can have a profile with an uppermost top at an elevation at least as low as an uppermost top of the extension arm 80.

Referring to FIG. 30, the permanent magnet linear motor 550 can be carried by the head 88. The forcer 554 can be coupled to and carried by the head 88, while the shaft 558 can be coupled to the shuttle 120. The permanent magnet linear motor 550 can have a profile with an uppermost top at an elevation at least as low as an uppermost top of the extension arm 80. In another aspect, the permanent magnet linear motor 550 can have a profile with an uppermost top at an elevation below the extension arm 80 to allow the head 88 to pivot as described herein.

Figure 31:
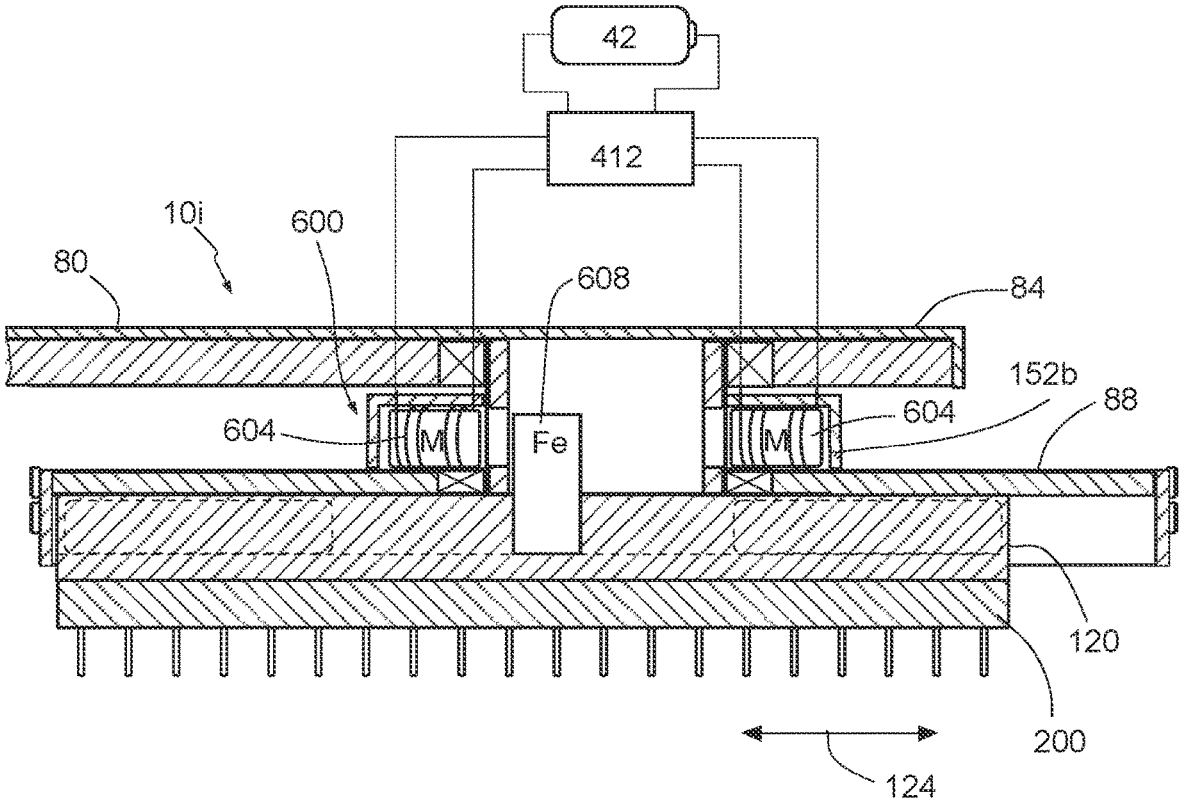
FIG. 31 is a partial cross-sectional side view of an extension arm and a head with an example linear actuator of a cleaning machine in accordance with one embodiment.

Referring to FIG. 31, another machine 10*i* is shown that is similar in many aspects to the machines 10-10*h* described above, and which descriptions are incorporated here. The machine 10*i* can have a reciprocating linear actuator 600 located at the distal end 84 of the extension arm 80. The linear actuator 600 can comprise a pair of spaced-apart electromagnets 604 and a ferromagnetic tab 608 movably disposed between the electromagnets 504. Alternating application of electricity to the pair of electromagnets 604 can drive the ferromagnetic tab 608 back and forth in a reciprocating manner along the linear axis 124. The electromagnets 504 can be coupled to the battery 42 and control electronics 612 to alternate application of electricity between the electromagnets 504. In one aspect, the electromagnets 604 can be coupled to and carried by the head 88 (or the extension arm 80), while the ferromagnetic tab 608 can be coupled to the shuttle 120. The reciprocating linear actuator 600 can have a profile with an uppermost top at an elevation at least as low as an uppermost top of the extension arm 80. Thus, the extension arm 80 and the reciprocating linear actuator 600 can be inserted under equipment.

The term "ferromagnetic" is used herein to refer to a material or element that has magnetic properties and/or effected by magnetic fields, either by being magnetic, or being magnetically attracted to a magnet (such as by containing iron) such that one ferromagnetic material or element is magnetically attracted to another ferromagnetic material or element. Thus, a ferromagnetic tab can be a magnet or is magnetic, such as a permanent magnet, or is attracted to magnets, such as by containing iron (Fe).

Some aspects of the floor cleaning machine are described in U.S. patent application Ser. No. 10/212,538, filed Aug. 5, 2002, and published Feb. 5, 2005, as publication no. 2004/0019989, and Ser. No. 15/381,738, filed Dec. 16, 2016, and published Jun. 21, 2018, which are hereby incorporated herein by reference.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment." or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A floor cleaning machine, comprising:

a base, at least one wheel supporting the base on a support surface, a handle coupled to the base, a motor, and a power source carried by the base and coupled to the motor;

a low-profile extension arm extending from the base and having a vertical height less than 4¾ inches;

a head carried by a distal end of the extension arm, the head having a cavity with a rail therein and a downward-facing opening;

a shuttle carried by the head and reciprocally positioned in the cavity and on the rail and configured to reciprocate along a linear axis, the shuttle operatively coupled to the motor;

a scrub pad coupled to the shuttle through the opening in the head and configured to reciprocate with the shuttle, the scrub pad positioned to bear against the support surface;

the head being pivotally coupled to the distal end of the extension arm and selectively pivotal in a horizontal plane about a vertical axis;

the head having at least two different rotational orientations with respect to the extension arm to selectively orient the linear axis with respect to the extension arm;

a lock selectively locking the head in one of the at least two different rotational orientations, wherein the lock comprises:

a pair of slots associated with the head and corresponding to the at least two different rotational orientations; and a slide slidably coupled to the extension arm and selectively positionable in one of the pair of slots; and a quick-release coupling the slide to the extension arm and having a tight position fixing the slide to the extension arm and a loose position allowing the slide to slide with respect to the extension arm, wherein the quick-release comprises:

a lock slot in the slide;

a rod extending through the lock slot to the extension arm;

a cam carried by the rod and pivotal on the rod, the cam having a nose thicker from a pivot of the cam to press the slide against the extension arm in the tight position, the cam having a heel thinner from the pivot of the cam to release the slide from the extension arm in the loose position; and a tab extending from the cam to facilitate moving the cam between the tight and loose positions.

2. The floor cleaning machine in accordance with claim 1, further comprising:

a crank carried by the head and operatively coupled between the motor and the shuttle, the crank being rotatable about a rotational axis and having an offset orbital bearing offset from the rotational axis and engaging with the shuttle with rotation of the crank reciprocating the shuttle; and a crank bearing positioned between the head and the crank and adapted for both radial loads and axial loads.

3. The floor cleaning machine in accordance with claim 1, wherein the shuttle further comprises:

a solid polymer block forming a majority of the shuttle;

the block having opposite lateral walls of polymer engaging opposing sides of the cavity of the head;

the block having a bottom wall of polymer engaging the rail of the head; and the block being solid between the opposite lateral walls of the block and the bottom wall of the block.

4. The floor cleaning machine in accordance with claim 1, further comprising:

a splash guard carried by the head and positioned at least on opposite ends of the head transverse to the linear axis of the shuttle; and the splash guard having a height extending from the head to at least a distal bottom end of the scrub pad.

5. The floor cleaning machine in accordance with claim 1, further comprising:

a shroud carried by the head and circumscribing the head;

the shroud having a height extending from the head to at least a distal bottom end of the scrub pad;

a port associated the shroud;

a hose coupled to the port of the shroud;

a vacuum source carried by the base and coupled to the hose.

6. The floor cleaning machine in accordance with claim 1, further comprising:

a nozzle positioned near the head;

a solution tank carried by the base and configured to hold a cleaning liquid;

a tube extending between the solution tank and the nozzle; and a valve coupled in the tube near the handle to selectively open and close and configured to selectively dispense the cleaning fluid from the nozzle adjacent the head.

7. The floor cleaning machine in accordance with claim 1, further comprising:

a squeegee carried by the extension arm and having a resilient edge positioned substantially flush with a distal bottom end of the scrub pad.

8. The floor cleaning machine in accordance with claim 1, further comprising:

a transport wheel carried by the extension arm and pivotally coupled to the extension arm at a pivot;

the transport wheel pivotal between at least two positions, comprising:

a deployed position in which a bottom-most portion of the wheel is located below a distal bottom end of the scrub pad and configured to elevate the scrub pad from off of the support surface; and a retracted position elevated with respect to the deployed position and in which the bottom-most portion of the wheel is located above the distal bottom end of the scrub pad; and a lever arm coupled to the wheel opposite the pivot and having at least two positions, comprising:

a vertical position corresponding to the deployed position of the wheel; and a horizontal position corresponding to the retracted position of the wheel.

9. The floor cleaning machine in accordance with claim 1, wherein the scrub pad comprises a plurality of different scrub pads separately coupleable to the shuttle, and further comprising:

a snap-fit connection between the shuttle and each of the plurality of scrub pads separately, the snap-fit comprising:

a pair of pins extending from each of the plurality of scrub pads;

a groove in each of the pins;

a pair of bores in the shuttle to selectively receive one of the pairs of pins; and a detent in each of the bores of the pair of bores and engageable with a respective groove in a respective pin.

10. The floor cleaning machine in accordance with claim 1, wherein the motor further comprises:

at least one linear actuator carried by the distal end of the extension arm and having a profile with an uppermost top at an elevation at least as low as an uppermost top of the extension arm, the at least one linear actuator comprising:

a coil carried by the distal end of the extension arm; and a plunger reciprocally disposed in the coil and coupled to the shuttle.

11. The floor cleaning machine in accordance with claim 1, wherein the motor further comprises:

at least one linear actuator carried by the head and having a profile with an uppermost top at an elevation at least as low as an uppermost top of the extension arm, the at least one linear actuator comprising:

a coil carried by the head; and a plunger reciprocally disposed in the coil and coupled to the shuttle.

12. The floor cleaning machine in accordance with claim 1, wherein the motor further comprises:

a permanent magnet linear motor carried by the extension arm at the distal end thereof and having a profile with an uppermost top at an elevation at least as low as an uppermost top of the extension arm, the permanent magnet linear motor comprising:

a forcer with electromagnet coils carried by the distal end of the extension arm; and a shaft movably positioned in the forcer with an array of permanent magnets, the shaft coupled to the shuttle.

13. The floor cleaning machine in accordance with claim 1, wherein the motor further comprises:

a permanent magnet linear motor carried by the head and having a profile with an uppermost top at an elevation at least as low as an uppermost top of the extension arm, the permanent magnet linear motor comprising:

a forcer with electromagnet coils carried by the head; and a shaft movably positioned in the forcer with an array of permanent magnets, the shaft coupled to the shuttle.

14. The floor cleaning machine in accordance with claim 1, wherein the motor further comprises:

a reciprocating linear actuator carried by the head and comprising:

a pair of spaced-apart electromagnets carried by the head; and a ferromagnetic tab movably disposed between the electromagnets and coupled to the shuttle.

15. The floor cleaning machine in accordance with claim 1, wherein the motor is located at the distal end of the extension arm and over the shuttle.

16. A floor cleaning machine, comprising:

a base, at least one wheel supporting the base on a support surface, a handle coupled to the base, a motor, and a power source carried by the base and coupled to the motor;

a low-profile extension arm extending from the base and having a vertical height less than 4¾ inches;

a head carried by a distal end of the extension arm, the head having a cavity with a rail therein and a downward-facing opening;

a shuttle carried by the head and reciprocally positioned in the cavity and on the rail and configured to reciprocate along a linear axis, the shuttle operatively coupled to the motor;

a scrub pad coupled to the shuttle through the opening in the head and configured to reciprocate with the shuttle, the scrub pad positioned to bear against the support surface; and wherein the motor is located at the distal end of the extension arm and over the shuttle.

17. A floor cleaning machine, comprising:

a base, at least one wheel supporting the base on a support surface, a handle coupled to the base, a motor, and a power source carried by the base and coupled to the motor;

a low-profile extension arm extending from the base and having a vertical height less than 4¾ inches;

a head carried by a distal end of the extension arm, the head having a cavity with a rail therein and a downward-facing opening;

a shuttle carried by the head and reciprocally positioned in the cavity and on the rail and configured to reciprocate along a linear axis, the shuttle operatively coupled to the motor;

a scrub pad coupled to the shuttle through the opening in the head and configured to reciprocate with the shuttle, the scrub pad positioned to bear against the support surface;

the head being pivotally coupled to the distal end of the extension arm and selectively pivotal in a horizontal plane about a vertical axis;

the head having at least two different rotational orientations with respect to the extension arm to selectively orient the linear axis with respect to the extension arm; and wherein the motor is carried by the head and has a profile with an uppermost top at an elevation at least as low as an uppermost top of the extension arm.

18. A floor cleaning machine, comprising:

a base, at least one wheel supporting the base on a support surface, a handle coupled to the base, a motor, and a power source carried by the base and coupled to the motor;

a low-profile extension arm extending from the base and having a vertical height less than 4¾ inches;

a head carried by a distal end of the extension arm, the head having a cavity with a rail therein and a downward-facing opening;

a shuttle carried by the head and reciprocally positioned in the cavity and on the rail and configured to reciprocate along a linear axis, the shuttle operatively coupled to the motor;

a scrub pad coupled to the shuttle through the opening in the head and configured to reciprocate with the shuttle, the scrub pad positioned to bear against the support surface;

the head being pivotally coupled to the distal end of the extension arm and selectively pivotal in a horizontal plane about a vertical axis;

the head having at least two different rotational orientations with respect to the extension arm to selectively orient the linear axis with respect to the extension arm;

a lock selectively locking the head in one of the at least two different rotational orientations;

a crank carried by the head and operatively coupled between the motor and the shuttle, the crank being rotatable about a rotational axis and having an offset orbital bearing offset from the rotational axis and engaging with the shuttle with rotation of the crank reciprocating the shuttle; and a crank bearing positioned between the head and the crank and adapted for both radial loads and axial loads.

19. A floor cleaning machine, comprising:

a base, at least one wheel supporting the base on a support surface, a handle coupled to the base, a motor, and a power source carried by the base and coupled to the motor;

a low-profile extension arm extending from the base and having a vertical height less than 4¾ inches;

a head carried by a distal end of the extension arm, the head having a cavity with a rail therein and a downward-facing opening;

a shuttle carried by the head and reciprocally positioned in the cavity and on the rail and configured to reciprocate along a linear axis, the shuttle operatively coupled to the motor, the shuttle comprising:

a solid polymer block forming a majority of the shuttle;

the block having opposite lateral walls of polymer engaging opposing sides of the cavity of the head;

the block having a bottom wall of polymer engaging the rail of the head; and the block being solid between the opposite lateral walls of the block and the bottom wall of the block;

a scrub pad coupled to the shuttle through the opening in the head and configured to reciprocate with the shuttle, the scrub pad positioned to bear against the support surface;

the head being pivotally coupled to the distal end of the extension arm and selectively pivotal in a horizontal plane about a vertical axis;

the head having at least two different rotational orientations with respect to the extension arm to selectively orient the linear axis with respect to the extension arm;

a lock selectively locking the head in one of the at least two different rotational orientations.

* * * * *